US007650870B2

(12) United States Patent
Fisher

(10) Patent No.: US 7,650,870 B2
(45) Date of Patent: Jan. 26, 2010

(54) CRANKSHAFT BEAM PISTON ENGINE OR MACHINE

(76) Inventor: Patrick T. Fisher, 2640 Northaven Rd., Suite 104, Dallas, TX (US) 75229

( * ) Notice: Subject to any disclaimer, the term of this patent is extended or adjusted under 35 U.S.C. 154(b) by 0 days.

(21) Appl. No.: 12/425,879

(22) Filed: Apr. 17, 2009

(65) Prior Publication Data

US 2009/0199811 A1 Aug. 13, 2009

Related U.S. Application Data

(62) Division of application No. 11/226,794, filed on Sep. 14, 2005, now Pat. No. 7,328,682, and a division of application No. 11/958,198, filed on Dec. 17, 2007, now Pat. No. 7,552,707.

(51) Int. Cl.
*F02B 75/32* (2006.01)

(52) U.S. Cl. ..... 123/197.4

(58) Field of Classification Search ..... 123/197.4, 123/48 B, 78 F, 53.3, 54.1, 55.2
See application file for complete search history.

(56) References Cited

U.S. PATENT DOCUMENTS 4,092,957 A * 6/1978 Tryhorn ..... 123/48 B

* cited by examiner

*Primary Examiner*—Hai H Huynh
(74) *Attorney, Agent, or Firm*—Booth Albanesi Schroeder LLC; Peter V. Schroeder

(57) ABSTRACT

Disclosed are crankshaft, single-plate cam and beam mechanisms that provide significant improvements in performance for 2- & 4-stroke engines, compressors and pumps. These cost effective mechanisms include linkages with the new and improved use of pivoting arms that operate with a variety of cylinder arrangements. One embodiment of the crankshaft mechanism has its crankpin roller positioned within a novel yoke-arm. The cam mechanism uses a pair of centrally positioned parallel links that are connected to roller cam followers and single or diametrically-opposed pistons. A pair of laterally extending follower arms connects to the ends of the links to provide support and alignment for the piston rods. Between the reciprocating links, cam followers and follower arms is a rotating odd-lobe plate cam. A beam mechanism uses opposite-direction extending balancing beams that are connected to links, cam followers and piston rods.

10 Claims, 27 Drawing Sheets

CRANKSHAFT BEAM PISTON ENGINE OR MACHINE

CROSS-REFERENCE TO RELATED APPLICATIONS

This application is a divisional of U.S. Ser. No. 11/226,794, filed Sep. 14, 2005, now U.S. Pat. No. 7,328,682 B2, issued Feb. 12, 2008, entitled "Improved Efficiencies for Piston Engines or Machines", and U.S. Ser. No. 11/958,198, filed Dec. 17, 2007, now U.S. Pat. No. 7,552,707 entitled "Improved Efficiencies for Cam-Drive Piston Engines or Machines," the disclosures of which are incorporated herein by reference in their entirety for all purposes.

STATEMENT REGARDING FEDERALLY SPONSORED RESEARCH OR DEVELOPMENT

Not applicable

REFERENCE TO MICROFICHE APPENDIX

Not applicable

TECHNICAL FIELD OF THE INVENTION

The present invention relates to reciprocating piston power drive equipment that operates with reciprocating engines, compressors, fluid motors and pumps. Piston equipment includes vehicles, aircraft, boats, air conditioners and power tools.

BACKGROUND OF THE INVENTION

Conventional piston engines and compressors use a crankshaft with an attached piston rod linkage, thereby causing limitations in the areas of efficiency, balance, noise, power shaft rpm reduction, weight and cost. These limitations are caused by six primary disadvantages: (1) Conventional crankshaft mechanisms oscillate the piston rods causing rod vibrations and piston side thrust resulting in piston friction. (2) Conventional crankshaft mechanisms have constraints for increasing piston dwell at the top of the stroke to improve engine efficiency. (3) Because of piston connecting rod angularity, conventional crankshaft mechanisms have non-harmonic piston motion which causes secondary inertia force vibrations for most arrangements. (4) For the operation of diesel engines, conventional crankshaft mechanisms cause piston knocking against the cylinder walls because of piston rod oscillations in combination with high combustion pressures. (5) Crankshafts require heavy counterweights for balance and transmissions for power shaft rpm reduction. (6) Conventional crankshafts require 4-stroke instead of 2-stroke operation for optimum efficiencies which result in increased weight and cost.

Diametrically-opposed piston, yoke crankshaft (scotch yoke) engines have been acknowledged for over 100 years. The scotch yoke engine has been given much consideration by a few manufacturers for replacing some conventional crankshaft engines. Today, several companies are continuing to develop and promote the yoke crankshaft engine in an attempt to establish acceptance by the public.

In U.S. Pat. Nos. 399,593; 2,122,676; 2,513,514; 4,013,048 and 5,331,926, there are disclosed yoke crankshaft engines. The crankpin carries a slider block or crankpin roller that rolls within the yoke-follower (yoke). The yoke-follower is connected to the ends of the piston rods; the pistons and rods reciprocate along a centerline perpendicular to and intersecting the crankshaft axis. Therefore, these engines eliminate piston rod angularity and provide harmonic piston motion that results in the benefits of longer piston dwell and less vibration.

With the opposed-piston yoke crankshaft engine, lateral movement of the crankpin with its attached roller causes piston side thrust against the cylinder walls and piston friction; but, less friction than conventional crankshaft engines for the same rod length. Because of the increased piston dwell at the top of the stroke and reduced piston friction, the yoke crankshaft engine efficiencies are substantially improved when compared to today's short to medium length piston rod conventional engines. However, a drawback for the present day yoke crankshaft is that for diesel engines the piston rods need to be extra heavy for supporting forces related to the lateral movement of the crankpin roller bearing.

The yoke crankshaft engine has a third advantage in that under-piston scavenging pumps can be provided for 2-stroke opposed-piston engine operation. Since the piston rods reciprocate along the axis of the cylinders, rod seals can be easily installed to seal off the crankcase allowing a low cost and compact means of self-aspirating 2-stroke engines. When operating as a 2-stroke two-cylinder engine with 180° alternating power strokes and using auxiliary balancing weights for low vibration, the yoke crankshaft engine becomes a formidable rival to the much more complex and expensive 4-stroke four-cylinder, horizontally-opposed or in-line conventional engine. Because of feasibility limitations, a drawback for present day yoke crankshaft engines is that they are limited to horizontal-opposed cylinder arrangements.

In attempting to overcome the kinematic disadvantages of the crankshaft mechanism, cam engines have been developed. Primary drawbacks for cam engines are structural complexity and increased expense which are caused by the difficulty in providing a simple means for maintaining cam followers in contact with the cam track. Cam engines generally have less piston friction and improved balance compared to crankshaft engines.

In U.S. Pat. Nos. 1,817,375; 2,124,604 and 4,697,552, there are disclosed single-plate three-lobe cam engines. These engines include slides or rollers for supporting the sides of links (linking-rods) that couple together diametrically-opposed pistons. Each link also connects two opposed roller cam followers that make contact on opposite sides of a three-lobe cam. The connecting pistons, followers and links reciprocate along a centerline perpendicular to and intersecting the cam axis, thereby promoting harmonic piston motion. The conventional art of guiding and supporting the links is a simple and low-cost linkage arrangement for maintaining the roller followers in contact with the cam, and these linkages serve many light duty machine applications such as typesetting, automatic packing, shoe making, etc. However, for heavy duty applications like engines and compressors, link side thrust and link friction become a problem. The above patents describe linking-rod engines which use heavy duty links to support the side thrust that is delivered from the attached roller followers. To provide link support and alignment, the links require precision bearing surfaces that maintain contact with precision aligned rollers or link guides; the link guides require high oil pressures to reduce friction and wear.

In U.S. Pat. Nos. 4,011,842 and 4,274,367, there are disclosed crankshaft beam engines that use a pair of attached longitudinal extending arms for providing a rocker beam (rocker lever). These engines have one beam which is connected to either one or two single-throw crankshafts for a single row engine. Disadvantages for these engines are cost, balance and limited to low piston speed applications. They require multiple unit-rows for good balance, and for single row applications require very large counter weights and still have poor balance. Because of virtually eliminating piston friction, these beam engines have been commercially successful for some low piston speed applications.

U.S. Pat. No. 2,417,648 discloses opposed pairs of beams for a four-lobe cam engine that was improved and built later as a two-lobe cam engine for marine and stationary applications by Svanemolle Wharf Co. of Copenhagen, Denmark. (Heldt in Auto. Ind., Jun. 15, 1955, "Two-stroke Diesel has no Crankshaft") This engine met with limited success for some low rpm commercial uses. The two-lobe cam allows the elimination of transmissions for marine and some stationary applications. For one row, this double-opposed piston engine has the added advantage of 2-stroke operation using two opposed pistons in one cylinder with the cylinder positioned between the beams. For a one-row diesel, this engine has the disadvantages of requiring three cams with four roller cam followers, two auxiliary follower arms and heavy opposed beams. Also, this engine operates at very low piston speeds which further increase engine weight per bhp. Because of these disadvantages, the weight and cost of this 2-stroke beam engine are substantially increased when compared to conventional crankshaft engines.

Sulzer in Switzerland has been successful producing a somewhat similar type of opposed beam diesel engine which uses a two-throw crankshaft (instead of cams) with double-opposed pistons. For each row, the crankshaft throws are connected to a pair of offset crankshaft connecting rods which are connected to the offset ends of complex and heavy opposed pair of beams. Each piston requires a separate crankshaft throw, two connecting rods, a heavy beam and large housing, thereby increasing weight and cost that result in limited applications.

Prior art piston machines have many disadvantages that have been only slightly improved over the past decades. Engine efficiency, weight and cost, although somewhat improved, have not had substantial progress in these areas. Attempts have been made to replace the conventional crankshaft mechanism with various yoke crankshaft, cam and beam machine designs, but with limited success. Complexity, cost and marginal operational improvements have prevented these "improved" machines from coming to the forefront in today's marketplace. The present invention overcomes most of the disadvantages discussed in this "Background of the Invention" for the prior art crankshaft, cam and beam machines. Additionally, conventional engines use superchargers that are expensive, heavy and consume lots of space. The invention provides the novel use of under-piston pumps that overcome the disadvantages of the weight and expense characteristic of conventional superchargers while providing the same benefits of increased power, improved air-fuel mixing, fuel economy and lower emissions.

SUMMARY OF THE INVENTION

This piston machine invention provides novel yoke-arm crankshaft, radial plate cam and crankshaft beam mechanisms. These mechanisms can improve the performance of reciprocating engines, compressors and liquid pumps by the novel use of pivoting arms and beams that provide several advantages. One advantage is that the anus and beams maintain the piston rod alignment in a path close to the axial line of the cylinders. This substantially reduces piston friction caused by piston rod angularity. Reduced piston friction has the benefits of longer engine life, less cooling, higher efficiencies and increased power. The mechanical efficiency of the invention is generally over 90% and greater than 94% can be achieved when using anti-friction bearings.

Another advantage of these improved mechanisms is increased piston dwell that allows combustion to take place for a longer duration near the top of the stroke. The invention's cam, cam beam and crankshaft beam mechanisms provide 15-40% longer piston dwell compared to prior art machines. For the invention's opposed-piston, two yoke-arm crankshaft arrangement, piston dwells of 250% more than prior art yoke crankshaft or conventional crankshaft engines can be achieved. The invention's yoke-arm crankshaft dwell increases are provided by the yoke design, the yoke-arm's pivoting angle and/or relative alignment of the cylinders; and for the crankshaft beam mechanism, favorable rod angularity and cylinder positioning determine piston dwell. For the cam, piston dwell can be adjusted by modifying the cam's contour design and by cylinder positioning. This feature of longer piston dwell provides substantially improved fuel efficiencies, increased power and reduced emissions.

Because piston rods are not directly connected to a crankshaft, piston rod angularity and secondary inertia vibratory forces are virtually eliminated. The result is that the invention's yoke-arm crankshaft, cam and crankshaft beam mechanisms have substantially lower vibration in comparison to today's conventional machines.

Piston knocking is a problem for conventional diesel engines which have high combustion forces and oscillating piston rods that cause piston slap against the cylinder walls. For diesel engine applications, the invention is not affected by high compression ratios that result in piston noise because the piston rod axial alignment significantly reduces the piston lateral movement against the cylinder walls.

The simplest and most compact mechanism of the invention is a yoke-arm crankshaft that uses a one-throw crankshaft with its crankpin positioned through a roller that rolls within a pivoting yoke-arm. The pivoting yoke-arm is connected to the lower end of one piston rod reciprocating within a single-cylinder or two opposed-piston rods reciprocating within two diametrically-opposed cylinders. Also, the yoke-arm mechanism can be arranged to operate as a two-throw horizontal-opposed arrangement. An alternative V-twin arrangement uses a pair of yoke-arms and one crankpin which carries a pair of rollers. A three or six-cylinder radial arrangement uses three yoke-arms that extend in the same rotary direction about a single-throw crankshaft which carries three crankpin rollers.

The simplest novel cam mechanism includes two opposed follower arms, a one-lobe disk cam, a pair of parallel links, two cam followers, and one piston rod for a single-cylinder arrangement. The cam is positioned between and parallel to the pair of links, and a follower pin connects the pivoting end of each follower arm to a cam follower and to the respective link pair end; one end of the link pair connects to a piston rod. The pivoting follower arms guide and provide alignment for the links, cam followers and piston rod.

By using low-cost follower arms that maintain operative link alignment and support, the invention overcomes the expensive link support problem which is a drawback for present day linking rod, cam engine mechanisms. Light weight links supported at their opposite ends by a pair of opposite-direction extending short pivot arms virtually eliminate piston side thrust and link friction. Compared to conventional links, the arms and links operate with very little friction.

An alternative piston machine embodiment includes the previously discussed single cam mechanism with the addition of two beam arms that are attached to the follower arms. This provides a new type of self-balancing and offset (opposite-direction extending) rocker beam (rocker lever) mechanism for several types of cylinder arrangements. One beam configuration provides a single row, diametrically-opposed and offset cylinder arrangement for a four-cylinder engine or compressor, wherein the ends of the offset beam arms are connected to a pair of offset pistons. Another cam beam configuration is an in-line, three-cylinder arrangement with the beams positioned on one side of the cam track for a compact design. When these beam mechanisms function with a cam (one or three-lobe), there is an advantage of low vibration because the offset pair of beam arms, pistons and rods provide offsetting inertia forces and in unison harmonic motion. In comparison to the conventional crankshaft, these cam beam mechanisms provide low cost. low vibration alternatives for single-cylinder, in-line twin and two-cylinder diametrically-opposed arrangements.

Conventional means for balancing three-lobe cam mechanisms require complex and costly designs for four unit-rows or six-cylinder radials. These complex designs are eliminated by the invention's simple structure cam beam mechanism which can use a one, three or five-lobe cam. Three-lobe cam mechanisms have the advantages of not requiring counter weights, and for many applications, the elimination of a transmission.

For radial piston applications, one arrangement of the invention includes a one-lobe disk cam, four-cylinder radial configuration that has opposed cylinders spaced at 90° intervals. Two pairs of opposed follower arms are connected to the respective opposed pistons. This four-cylinder radial arrangement requires a one-lobe cam for balance, and for 2-stroke engines, has a power stroke every ¼th rotation of the output shaft providing smooth torque. This 2-stroke four-cylinder radial is comparable in performance to today's 4-stroke V-8 engine while having the additional advantages of improved fuel economy, decreased emissions and reduced vibration. Alternatively, this mechanism can be arranged to operate as a V-type or semiradial type arrangement. A three-lobe cam can be used, but requires four rows for balance, whereby vibrations are cancelled out due to the offset reciprocating forces.

For providing an alternative four-beam, eight-cylinder radial arrangement, the four follower arms, as described in the previous four-cylinder radial discussion, can be attached to four beam arms that connect to four additional pistons. This beam radial arrangement can be used with one or three-lobe cams.

Another alternative of the invention is a one or three-lobe cam with three or six cylinders radially spaced about a power shaft that operate with three sets of follower arms, links and cam followers. When using a three-lobe cam, this arrangement provides offsetting inertia forces for the reciprocating components, thereby eliminating shaft counter weights.

A simple structure beam machine of the invention consists of a single throw crankshaft beam mechanism similar to the invention's cam beam mechanism except the cam, links and cam followers are replaced with a crankshaft and beam rod(s). Compared to the cam beam, the crankshaft beam arrangement has more vibration because of rod angularity. The centrally located piston(s) provide the same piston dwell as prior art, but the invention's outer pistons provide up to 40% increased dwell for improved efficiencies.

The invention's yoke-arm crankshaft, cam, cam beam and crankshaft beam mechanisms provide 2-stroke and 4-stroke engines with high mechanical and fuel efficiencies. These novel mechanisms will allow lower cost 2-stroke engines to replace the heavier and more expensive 4-stroke engines for many applications. These 2-stroke two-cylinder engines provide low vibration and alternating 180° power strokes for smooth torque, and can include multiple rows to form multiple cylinder arrangements for a wide variety of applications. Through the use of several types of novel self-charging and self-supercharging means, both the 2-stroke and 4-stroke engines benefit from lower cost, lower weight and for some arrangements, improved air-fuel mixing and lower emissions compared to prior art.

BRIEF DESCRIPTION OF THE DRAWINGS

For a more complete understanding of the present invention, and for further details and advantages thereof, reference is now made to the following "Detailed Description" taken in conjunction with the accompanying drawings, in which.

DETAILED DESCRIPTION

The invention provides reciprocating piston machines with novel yoke-arm crankshaft, plate cam and eccentric beam mechanisms which include the new and improved use of pivoting arms. Reduced piston friction and increased piston dwell are some of the fundamental advantages featured by the invention. Some arrangements described are: (1) single-cylinder, (2) in-line twin, (3) opposed two-cylinder, (4) V-twin, and (5) semiradial and radial.

These reciprocating piston machines relate to internal combustion engines, compressors, steam engines, fluid motors and pumps; the machines operate with piston power drive equipment that includes vehicles, aircraft, boats, air conditioners and power tools.

FIGS. 1-5 are arranged and function somewhat similar to conventional crankshaft engines except for the addition of yoke-arm(s) 6 and crankpin roller bearing(s) 4 that provide significant advantages.

Figure 1:
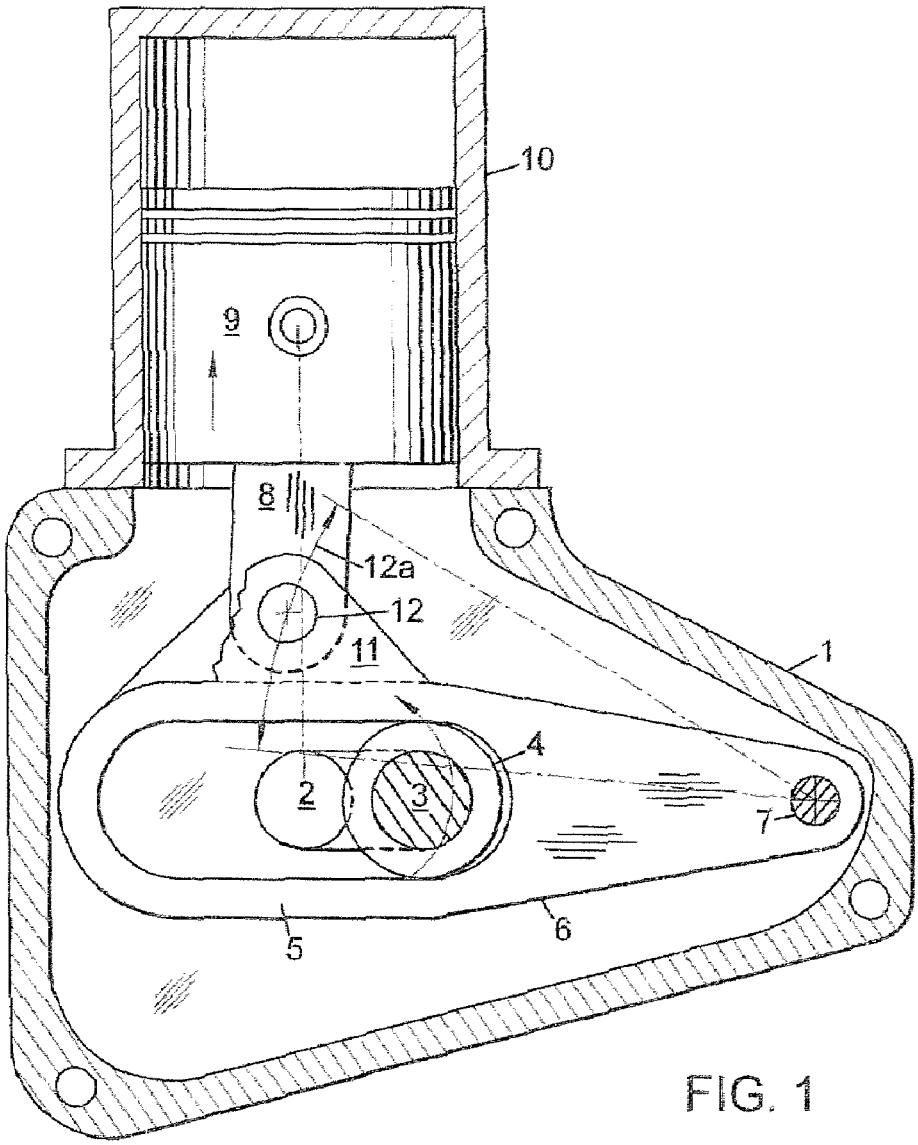
FIG. 1 shows a front sectional view of the invention's yoke-arm crankshaft mechanism that has a single yoke-arm and single-throw crankshaft connected to a piston that reciprocates within a cylinder.

In FIG. 1, there is shown one embodiment of the invention that is a single-cylinder, yoke-arm crankshaft machine which provides the simplest structure and most compact arrangement of the invention. Crankcase 1 supports a single-throw crankshaft 2 with its crankpin 3 positioned through a crankpin roller bearing 4. A yoke-follower 5 is located at the pivoting yoke end of laterally-extending yoke-arm 6. The arm's opposite end or pivot pin end is connected to crankcase 1 by fixed arm pivot pin 7. Roller bearing 4 engages with the yoke-follower 5 and moves back-and-forth between two generally laterally-extending opposed yoke-follower track surfaces such that the yoke-arm 6 is oscillated by rotation of the crankpin 3. The track surfaces are generally parallel to one another and generally aligned with the longitudinal axis of the yoke-arm, but the track surfaces can be nonlinear such as in some prior art designs. The upper part of yoke-arm 6 is extended outward to form an armfork 11 that is pivotally connected to the lower end of piston rod 8 by piston rod pin 12 with a siamesed pivotal connection. Rod 8 is pivotally connected at its opposite end to piston 9 that reciprocates within cylinder 10 which is attached to crankcase 1.

Figure 1A:
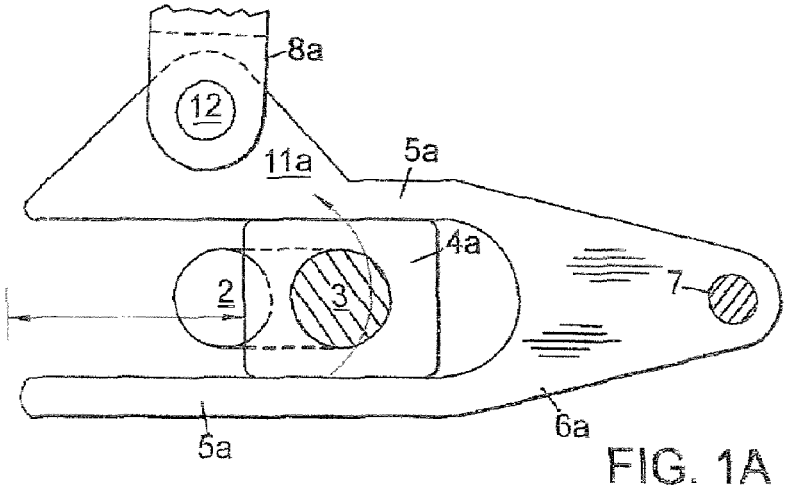
FIG. 1A shows an alternative yoke-arm of FIG. 1 which has an open yoke end and a slide block crankpin bearing that replaces the roller crankpin bearing.

In FIG. 1A, there is shown an alternative yoke-arm 6*a* for FIG. 1. FIG. 1A shows an alternative siamesed pivotal connection, wherein the yoke-arm 6*a* has a yoke-arm ear 11*a* that is connected to the piston rod's 8*a* forked end. Also shown, is an open end yoke-follower 5*a* opposite the pivot end. Crankpin slide-block bearing 4*a*, as an option, can replace the crankpin roller bearing 4 of FIG. 1.

For an opposed two-cylinder arrangement, FIG. 1 can be modified to include (not shown) an additional cylinder (horizontally or diametrically-opposed) containing a piston with its piston rod connected to a second armfork 11 extending from yoke-arm 6 opposite the first armfork 11. This arrangement provides a very compact and low-cost mechanism for opposed two-cylinder gasoline engines, compressors and pumps for both 2 and 4-stroke applications.

The yoke-arm crankshaft machine has substantially reduced piston friction when compared to the prior art yoke crankshaft machine without a yoke-arm. When compared to conventional crankshaft engines with pistons directly connected to the crankshaft, piston friction is even further reduced. During the piston stroke, the motion of piston rod pin 12 defines an arc 12*a* which maintains a close proximity to the cylinder axis. This close proximity makes possible less rod lateral movement for providing reduced piston friction. The yoke-arm virtually eliminates piston side thrust caused by the rotating crankpin which is a significant drawback for prior art yoke crankshaft and conventional crankshaft engines.

For providing higher engine efficiencies, longer piston dwells at the top of the stroke can be achieved by the invention. A number of factors affect piston dwell: (1) Changing the position of the cylinder axis relative to arc 12*a* formed by the motion of the piston rod pin will increase or decrease dwell; (2) Moving rod pin 12 further out from the yoke-arm 6 axis increases dwell, but causes increased piston rod lateral movement; (3) Shortening piston rod 8 increases piston dwell; (4) Shortening yoke-arm 6, as in FIG. 3, increases piston dwell; and (5) Changing the piston pin position increases or decreases dwell. Increasing dwell by these means will cause a slight increase in piston friction. These adjustments of piston dwell for the yoke-arm crankshaft can also be applied to the novel cam mechanisms and eccentric beam mechanisms as described later.

The FIG. 1 arrangement has more than 30% dwell increase when compared to functionally acceptable prior art yoke crankshaft machines and about 42% more dwell compared to conventional crankshaft machines. Increased piston dwell provides more complete combustion which results in improved power, fuel economy and fewer emissions.

The FIG. 1 single-cylinder arrangement has less secondary inertia forces than conventional crankshaft mechanisms because piston rods are not directly connected to crankpin 3; therefore, lower vibration is achieved. Similar to conventional arrangements, the FIG. 1 configuration can use balancing shafts to cancel out lateral forces from the crankshaft counterweights for providing excellent primary balance. When this single-cylinder arrangement operates as a 2-stroke, crankcase compression or under-piston pump engine with 360° power strokes, it becomes well suited as a replacement for conventional 4-stroke single-cylinder and two-cylinder engines. Multicylinder yoke-arm crankshaft arrangements of the invention can also use crankcase compression similar to conventional 2-stroke crankcase compression engines.

Figure 1B:
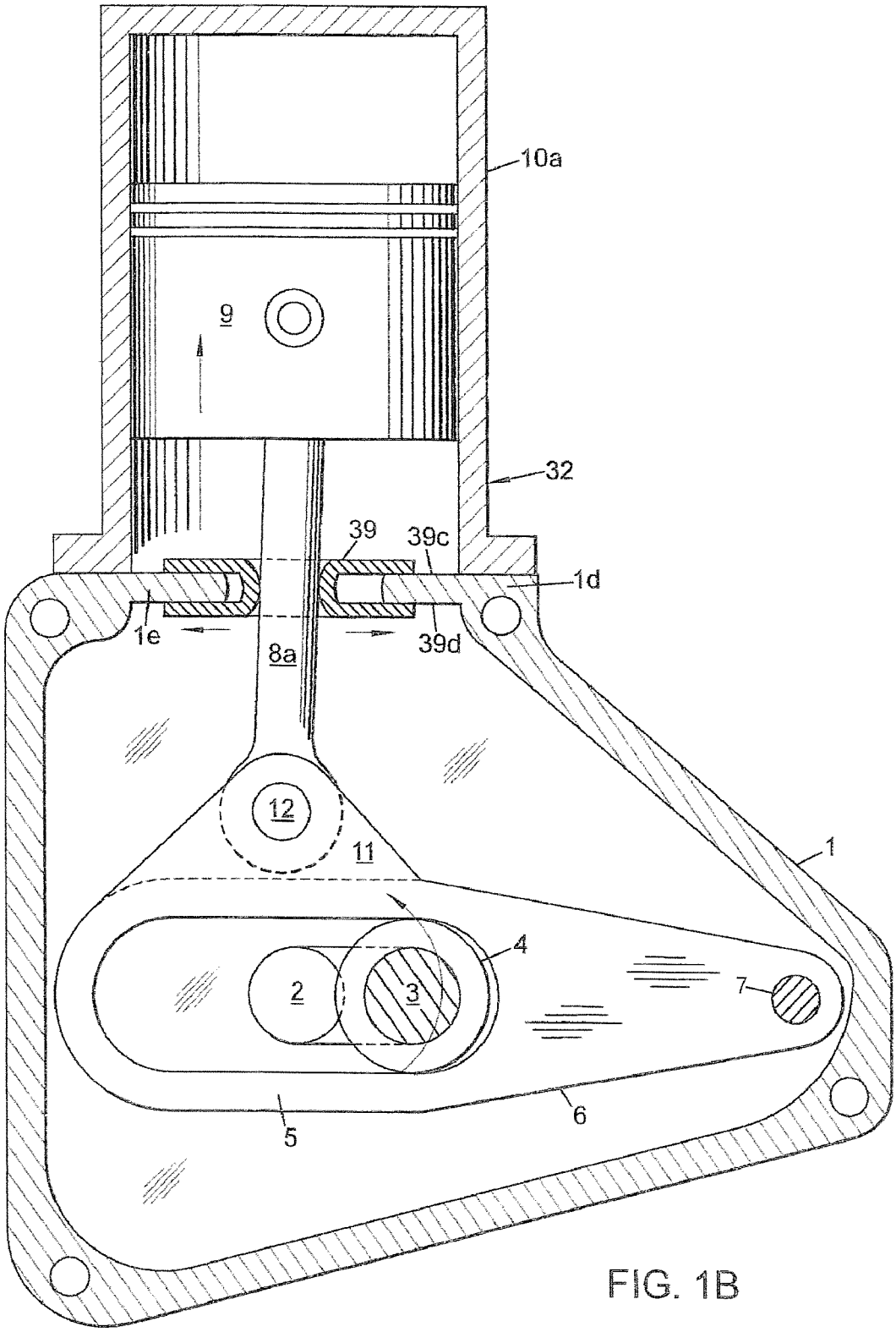
FIG. 1B shows FIG. 1 with the addition of an under-piston pump for 2-stroke charging.

In FIG. 1B, there is shown an under-piston scavenging pump 32, self-aspirating arrangement that is an addition to the FIG. 1 machine. The cylinder 10*a* contains a double-acting piston 9 for combustion at the piston head end and compression (charging) at the under-piston end. Piston rod 8*a* extends through the center of a sliding rod seal 39 and through a seal guide plate 1*e* passage of crankcase head 1*d* that seals off crankcase 1 to provide a pump chamber. This laterally-reciprocating U-ring style slider seal has parallel upper and lower sliding surfaces laterally-extending outward on upper guide surface 39*c* and on lower guide surface 39*d* of seal guide plate l*e* and is supported by crankcase head 1*d*. The convex inner seal surface seals continuously around oscillating piston rod 8*a* throughout the piston stroke. For ease of installation, the U-ring seal can be made in two or three sections and held together with a circumferential spring. This ability to seal off crankcase oil from pump 32 prevents contamination of crankcase oil by combustion products and fuel (the Sulzer RD-90 2-stroke diesel engine, for example). Under-piston scavenging pumps can be used, as an option, for all cylinder arrangements of the invention.

Figure 2:
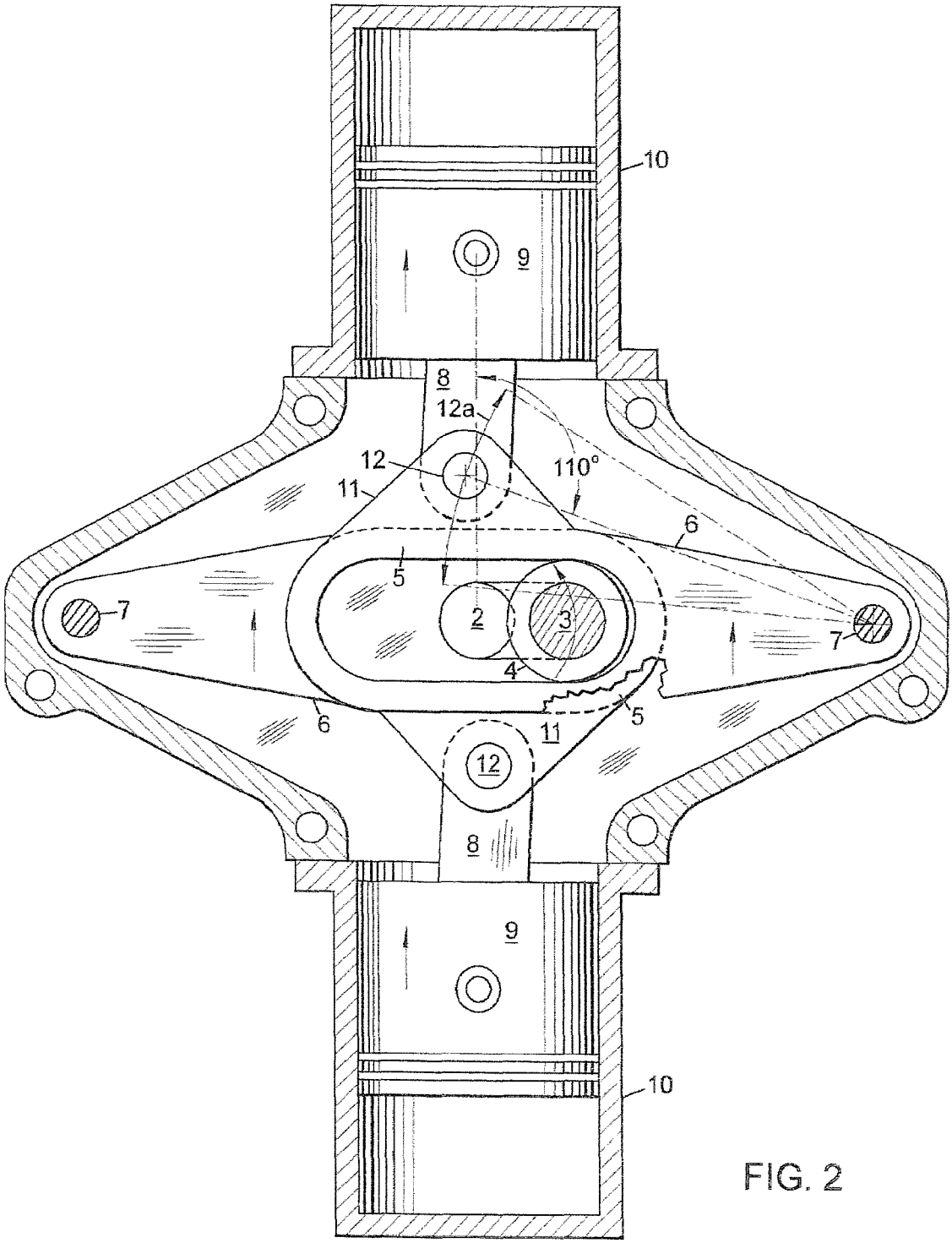
FIG. 2 shows a front sectional view of the crankshaft mechanism with a single throw and two yoke-arms connected to horizontally-opposed cylinders.

In FIG. 2, there is shown a double yoke-arm 6, single-throw crankshaft 2, two-cylinder 10 horizontally-opposed arrangement. The offset horizontally-opposed arrangement uses side-by-side yoke-arms. The yoke-arms are opposite-direction extending and connected to opposed pistons 9 by a pair of piston rods 8.

For lower vibration, FIG. 2 can be arranged with diametrically-opposed cylinders (axially aligned cylinders) whereby the longitudinal axes of yoke-arms 6 intersect the axis of the cylinders; the yoke-arms require a siamesed connection with crankpin 3. The first yoke-arm 6 has a single yoke-follower 5 end. The second yoke-arm has a yoke end consisting of a pair of yoke-follower 5 branches. The branches of the second yoke-arm are positioned on opposite sides of the first yoke-arm with each branch defining a yoke-follower. Each yoke-follower 5 having opposed follower track surfaces associated with a crankpin bearing such that the second yoke-arm 6 engages with two spaced apart crankpin bearings.

For an alternative arrangement of FIG. 2, the piston rods can be connected to the ends of yoke-arms 5 opposite pivot pins 7, wherein rod pins 12 can be positioned through the longitudinal axis of yoke-arms 6. This provides a more compact machine and reduces the rotating speed of the crankpin roller bearing although dynamic balance is reduced.

The use of long yoke-arms 6 and/or long piston rods 8 provides less piston friction. When operating as a 2-stroke gasoline engine, the FIG. 2 long arm 6 design has about 4% piston friction and about 8% for the shorter arm 6 design of FIG. 3. This compares to conventional 2-stroke engines that typically have 15-50% piston friction.

The invention's yoke-arm machine has inherent dwell increases (up to 20%) which are attributed to the relationship between the yoke-arm 6 pivot angle and crankpin 3. When the piston moves from TDC to mid-stroke, the pivoting motion of the yoke-arm causes the crankpin to rotate about 16° for FIG. 2 (and 21.8° for FIG. 3) further compared to the crankpin of prior art yoke crankshaft engines which have their yoke-follower axis perpendicular to the cylinder axis throughout the stroke.

The novel yoke-arm machine's new and improved linkages provide even further dwell increases (up to 20%) for a total of 40% increase when compared to prior art. Since prior art yoke crankshaft machines do not have rod oscillation or piston rod lateral movement, the amount of dwell is limited. Because the invention's yoke-arm machine has some limited piston rod lateral movement, significant increases in piston dwell are possible. Immediately after the downward or combustion stroke when maximum dwell occurs, piston rod pin 12 begins moving along arc 12*a* ("dwell arc") defined by the motion of rod pin 12, and dwell progressively decreases as the rod pin moves closer to the cylinder axis. For optimum machine efficiency and increased dwell, the cylinder axis should intersect near the central section of arc 12*a*. The obtuse angle as measured at mid-stroke and formed by the intersection of the cylinder axis and a line connecting the yoke-arm pivot pin to the piston rod pin is approximately 110°. The piston dwell increase is proportional to this angle which determines the amount of piston rod lateral movement or oscillation. Angle increases greater than the 90° threshold is when the invention begins to exceed the dwells of industry accepted prior art yoke crankshaft machines. Additional dwell increases of 20%, as previously mentioned, can be achieved when altering the cylinder position, yoke-arm length, piston rod length, and piston pin position, all affecting the mid-stroke obtuse angle. There is a trade-off between the amount of dwell desired vs. piston friction. Increased dwell causes increased piston friction, and design parameters such as the yoke-arm pivot angle, cylinder position, etc. must be collectively considered to achieve the desired machine efficiency.

Much greater increases in piston dwell (without increasing piston friction) can be achieved when using the yoke-follower designs of FIGS. 3A & 3B (described below) with the drawback of increased machine vibration. However, for FIG. 2 type configurations, vibration is minimized because of the two yoke-arm and opposed-piston arrangement.

As a 180° alternating power stroke, 2-stroke engine, FIG. 2 can be charged with under-piston scavenging pumps (ref. FIG. 1B) or crankcase compression. The FIG. 2 arrangement can be used as an alternative to replace many existing 4-stroke, four cylinder engine applications.

Figure 3:
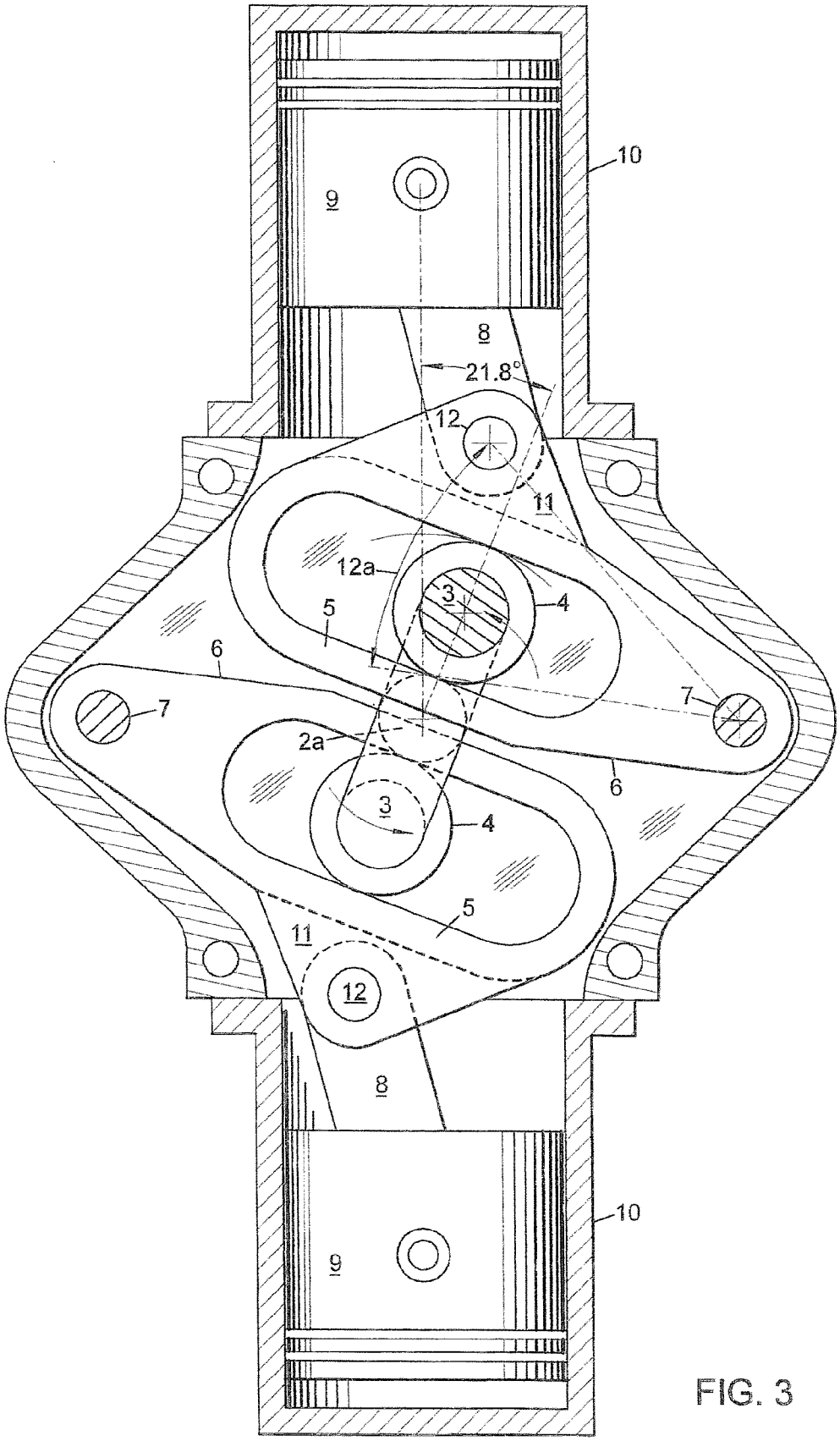
FIG. 3 shows a front sectional view of the crankshaft mechanism with two throws connected to two yoke-arms connected to horizontally-opposed cylinders.

In FIG. 3, there is shown a two yoke-arm 6, two-throw crankshaft 2*a*, two-cylinder 10 horizontally-opposed arrangement. The opposite-direction extending yoke-arms are connected to piston rods 8, and each crankpin 3 is positioned within a yoke-follower 5. This configuration operates somewhat similar to a conventional two-throw, two-cylinder horizontal-opposed arrangement. There is dynamic balance in the FIG. 3 arrangement because of the symmetrical opposing moving parts. The result is lower vibration when compared to conventional offset horizontally-opposed arrangements which have substantially more piston rod weight and rod oscillation. Also, piston dwell at the top of the stroke for the FIG. 3 yoke-follower design is about 50% longer compared to conventional crankshaft engines.

Figure 3A:
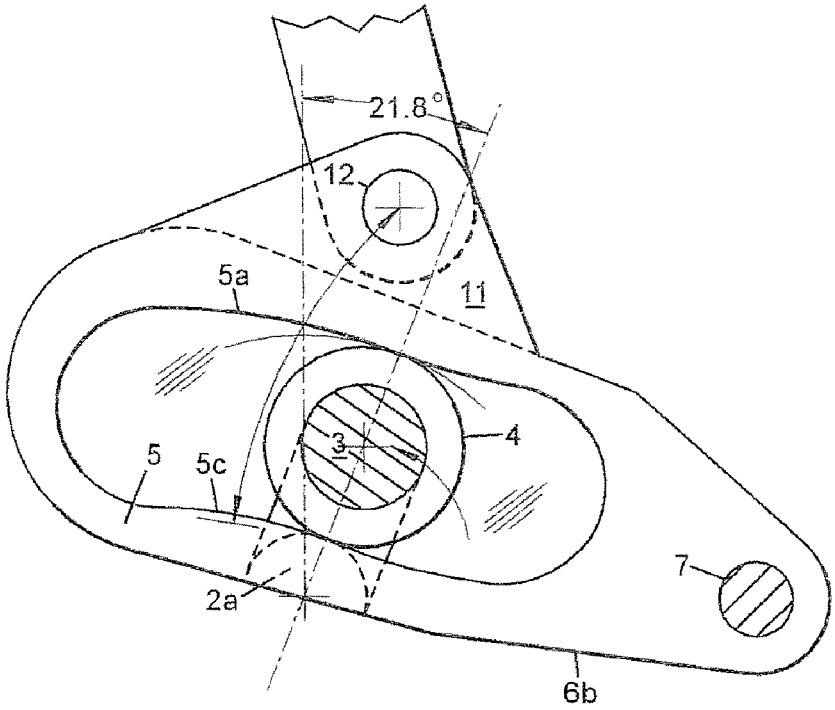
Figure 3B:
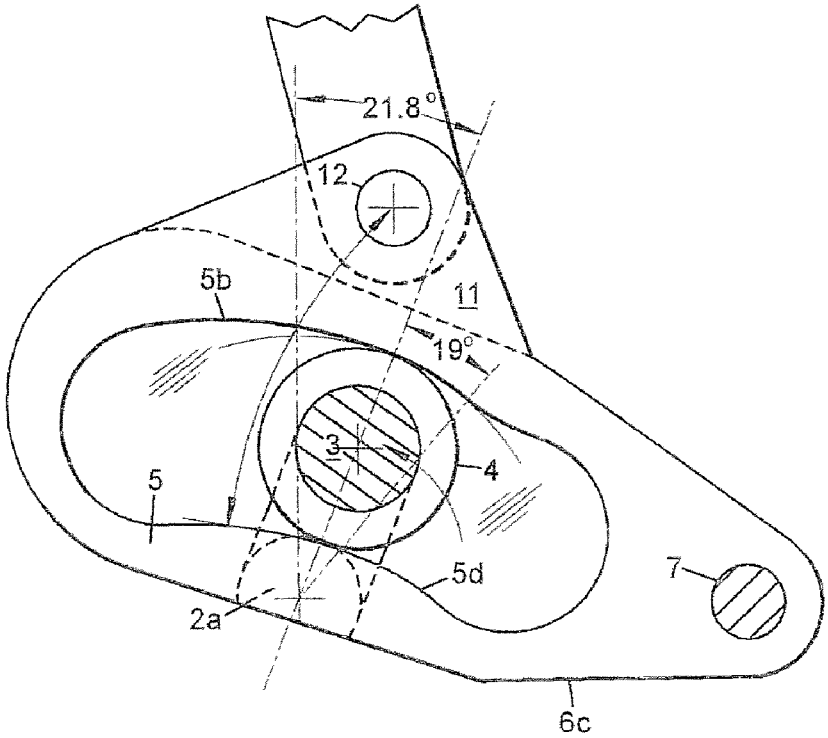

In FIGS. 3A & 3B, there are shown yoke-arms with concave yoke track surfaces 5*a* & 5*b* contacting the top of the crankpin bearing 4 and convex surfaces 5*c* & 5*d* at the bottom of the crankpin bearing.

In FIG. 3A, there is shown a yoke-arm 6*b* having its yoke-follower designed for providing further increases in piston dwell. Dwell increase at the top of the stroke is more than 50% longer compared to prior art yoke crankshaft machines which have their yoke-follower axis perpendicular to the cylinder axis. There is more than 65% longer dwell when compared to conventional crankshaft engines.

In FIG. 3B, there is shown a yoke-arm 6*c* design which provides over 250% dwell compared to conventional crankshaft engines. During the 19° crankpin travel interval shown in FIG. 3B, the piston pauses momentarily causing a substantial dwell increase. The increased curvature of the arc 5*b* track surface compared to arc 5*a* of FIG. 3A correspondingly increases the piston dwell. Different radiuses of the yoke-follower tracks provide changes in piston motion that affect dwell, but the increased inertia forces limit maximum piston speeds due to component parts stress. An optimum yoke-follower design factoring in these constraints is required for different applications.

Increases in piston dwell are especially important for diesel engines. With a properly designed yoke-follower, a 4000 rpm yoke-arm 6 diesel engine will have piston dwell increases which allow it to operate with the same piston dwells and fuel efficiencies compared to the more fuel efficient 1500 rpm diesel engines. And, with the improvement of much lower piston friction, the novel diesel engine's fuel economy will approximately double compared to conventional automobile diesel engines. Twice the fuel economy translates to significant increases in power and reduced engine weights for vehicles.

FIG. 3 can be configured with a yoke-arm from FIG. 3A or FIG. 3B with each having substantial dwell increases. The inherent balance characteristics of the horizontal-opposed piston configuration offset and cancel out the inertia forces caused by the differences in piston dwell for the different yoke-arms. However, there is some rocking imbalance which is characteristic of horizontally-opposed engines.

These horizontally-opposed arrangements can be used with an under-piston pump (ref FIG. 1B) for 2-stroke operation, 2-stroke with crankcase compression or 4-stroke engines.

Figure 4:
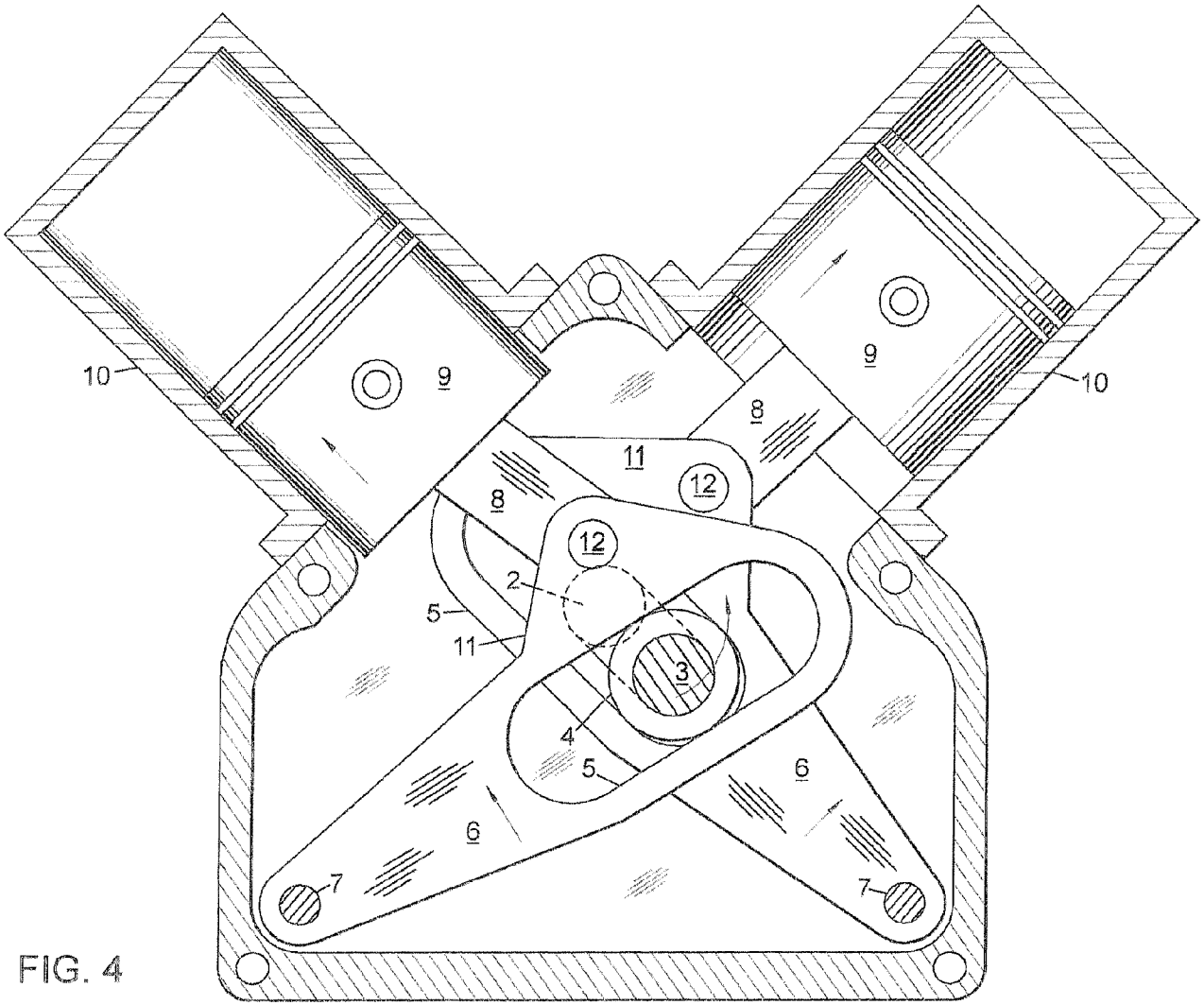
FIG. 4 shows a front sectional view of the crankshaft mechanism connected to V-twin cylinders.

In FIG. 4, there is shown a double yoke-arm, single-throw 90° V-twin cylinder arrangement. Double yoke-arms 6 are connected to crankpin 3, two rods 8 and two pistons 9. Because of the virtual elimination of secondary vibrations, this V-type arrangement has lower vibration than the conventional 90° V-type. Yoke-arms 6 are side-by-side similar to the FIG. 2 configuration. Among other applications, FIG. 4 is well suited for use as high mechanical efficient, compact compressors and pumps.

Figure 5:
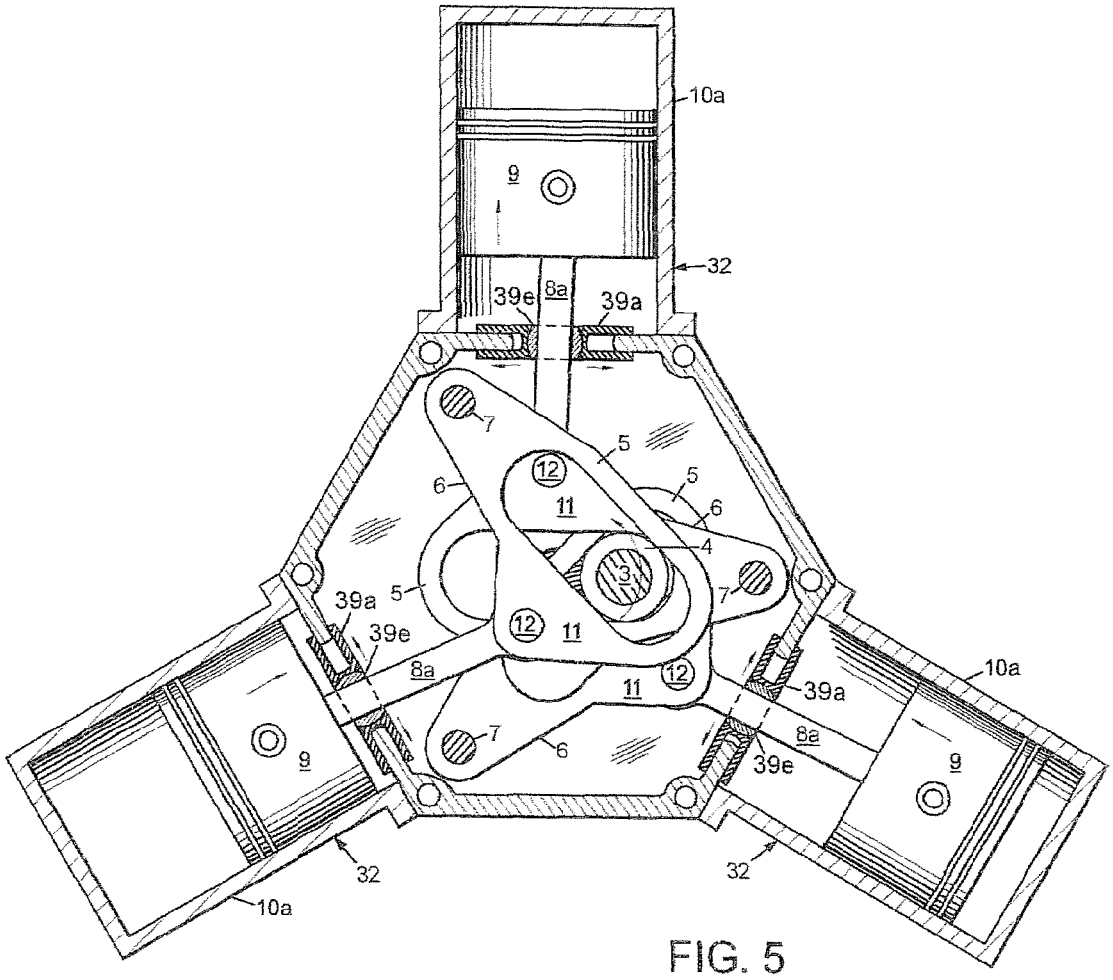
FIG. 5 shows a front sectional view of the crankshaft mechanism connected to three radial cylinders with under-piston pumps.

In FIG. 5, there is shown a three yoke-arm 6, single-throw crankshaft 2, three-cylinder 10*a* radial arrangement. Three arms are positioned in the same rotary direction about and connected to the crankshaft, wherein each yoke-arm 6 is connected to the same crankpin 3 with each yoke-follower 5 containing its respective crankpin roller bearing 4. Sliding rod seals seal off under-piston pumps 32 for charging. Each seal includes a swiveling spherical inner-ring 39*e* positioned within a laterally-sliding outer-ring 39*a* socket. The inner-ring contact wear is very low because of a relatively large contact surface area. The 120° power strokes for the FIG. 5 2-stroke design allow this arrangement to be well suited for lightweight and compact radial cylinder applications. As an option, one cylinder can be repositioned to its opposite side for providing a three-cylinder semiradial. Also, an additional three cylinders can be added to convert FIG. 5 into a six-cylinder radial.

The novel engine design of one piston attached to one yoke-arm provides the advantage of reduced crankpin roller bearing sliding friction compared to prior art opposed type engines. Because of cost constraints, prior art yoke crankshaft engines do not have single cylinder arrangements which are now feasible with the novel yoke-arm crankshaft. The prior art opposed cylinder has a single yoke-follower with the characteristic of roller bearing reversal during each stroke which promotes crankpin roller bearing wear. The yoke-arm single cylinder arrangement has limited bearing reversal and results in long bearing life. This long bearing life advantage extends to multicylinder arrangements of the invention. Additionally, the yoke-arm crankshaft mechanism has lower piston friction, substantially increased piston dwell and provides a variety of low cost cylinder arrangements.

In FIGS. 6-18, there are shown alternative piston machine arrangements which operate with variations of the invention's cam and cam beam mechanisms. For many applications, these machines provide 2-stroke arrangements that can replace conventional 4-stroke engines while offering advantages.

Similar to the invention's yoke-arm crankshaft, the cam mechanism's piston dwell is a function of (1) harmonic piston motion, (2) the position of the cylinder axis relative to the arc defined by the motion of follower pin 18, (3) piston rod length and (4) piston pin position. For optimum machine efficiency and increased dwell, the cylinder axis is generally tangent to the lower or central section of the arc that is defined by the motion of the piston rod pin 18 or when the cylinder axis intersects the arc's central section. In accordance, the obtuse angle as measured at mid-stroke and formed by the intersection of the cylinder axis and a line connecting the follower arm pivot pin 7 to the piston rod pin 18 is substantially greater than 90° (approx. 110°). The piston dwell increase is proportional to the amount of angle greater than 90°.

Unlike the yoke-arm crankshaft, the cam mechanism does not use yoke-arm pivoting angles for adjusting dwell, but instead the dwell is affected by the cam's track profile design. Like the yoke-arm crankshaft, when the cam mechanism's piston rod lateral movement is increased, piston dwell and piston friction are increased accordingly. For many applications, both the cam and yoke-arm mechanisms have sufficient piston dwell to achieve significantly improved engine efficiencies without depending upon rod oscillation for dwell. With invention designs that minimize rod oscillation, about 2% or less piston friction can be achieved. This compares to the 15-50% piston friction typical for conventional 2-stroke engines.

For a single row, the cam and cam beam mechanisms provide lower vibration compared to the yoke-arm crankshaft. Also, the cam mechanism has the advantage of using more cylinders (up to eight) with low vibration for single row (radial) arrangements.

Figure 6A:
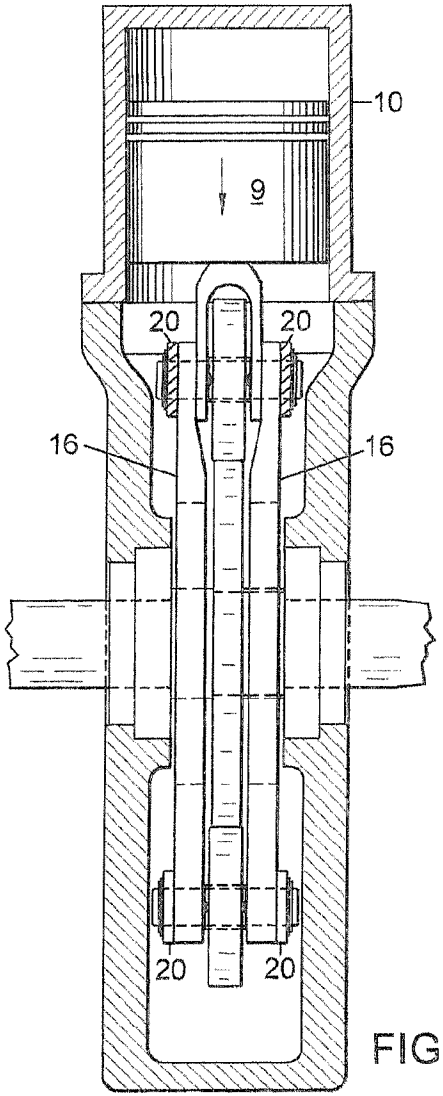
FIG. 6A shows a side sectional view of FIG. 6.
Figure 6:
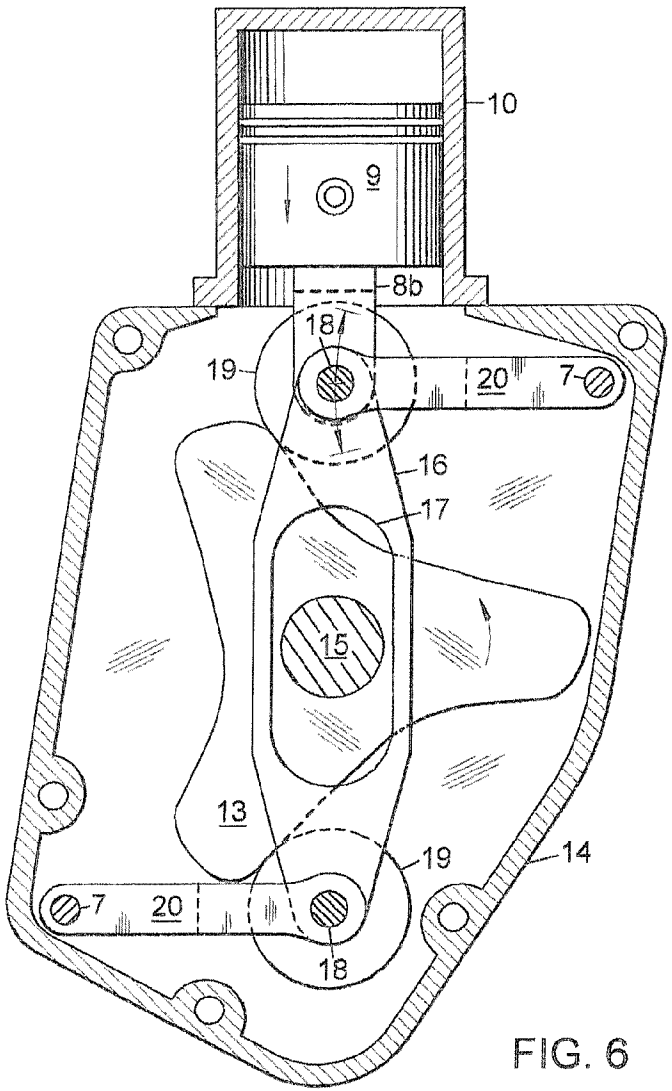
FIG. 6 shows a front sectional view of the invention's cam mechanism using a three-lobe cam, one pair of parallel links connected to two opposed follower arms all connected to a piston that reciprocates within a cylinder.

In FIGS. 6 & 6A, there is shown a linking arms, radial-can piston machine of the invention which includes a radial odd-lobe plate cam, opposing arms and follower arm link means. Camcase 14 supports a central rotatable camshaft 15 which is attached to a three-lobe cam 13. Positioned on opposite sides of cam 13 is a pair of parallel follower arm links 16 with centrally located oblong holes 17 that provide clearance for camshaft 15. The opposite ends of the link pair are attached to a pair of follower pins 18 that carry a pair of cam followers 19 (track rollers). Follower pins 18 connect the cam followers and links to the pivoting ends of the pair of laterally-extending follower arms 20 that extend outward on opposite sides of the follower arm link pair. Follower pin 18 also connects to piston rod 8*b* which connects to the wrist pin of piston 9. The opposite ends of the follower arms are attached to fixed pivot pins 7 for pivotally supporting the pivot ends of the arms to the camcase. A second piston rod and piston (not shown) can be connected to the lower follower pin 18 for providing a two-cylinder diametrically-opposed arrangement.

For acceptable balance, the FIG. 6 configuration requires a one-lobe cam with shaft balancing weights. An alternative for good balance is a two-cylinder, horizontal-opposed engine which uses two parallel offset odd-lobe plate cams attached to camshaft 15 with each cam having its own set of components (arms, links etc.). This odd-lobe dual cam configuration provides good dynamic balance similar to conventional horizontal-opposed engines. Offsetting inertia forces providing excellent dynamic balance can be achieved using one, three or five-lobe cams for three or more in-line rows.

For an alternative arrangement, the links 16 can be connected to the follower arms at different positions. The follower arm can be extended beyond the piston rod pin for further flexibility. When increasing the width of the cam roller bearing to accommodate higher loading, the link pair can be extended to enable relocation of the arm and piston rod to a second pin independently above the roller bearing allowing additional space to accommodate the extra bearing width.

Figure 7:
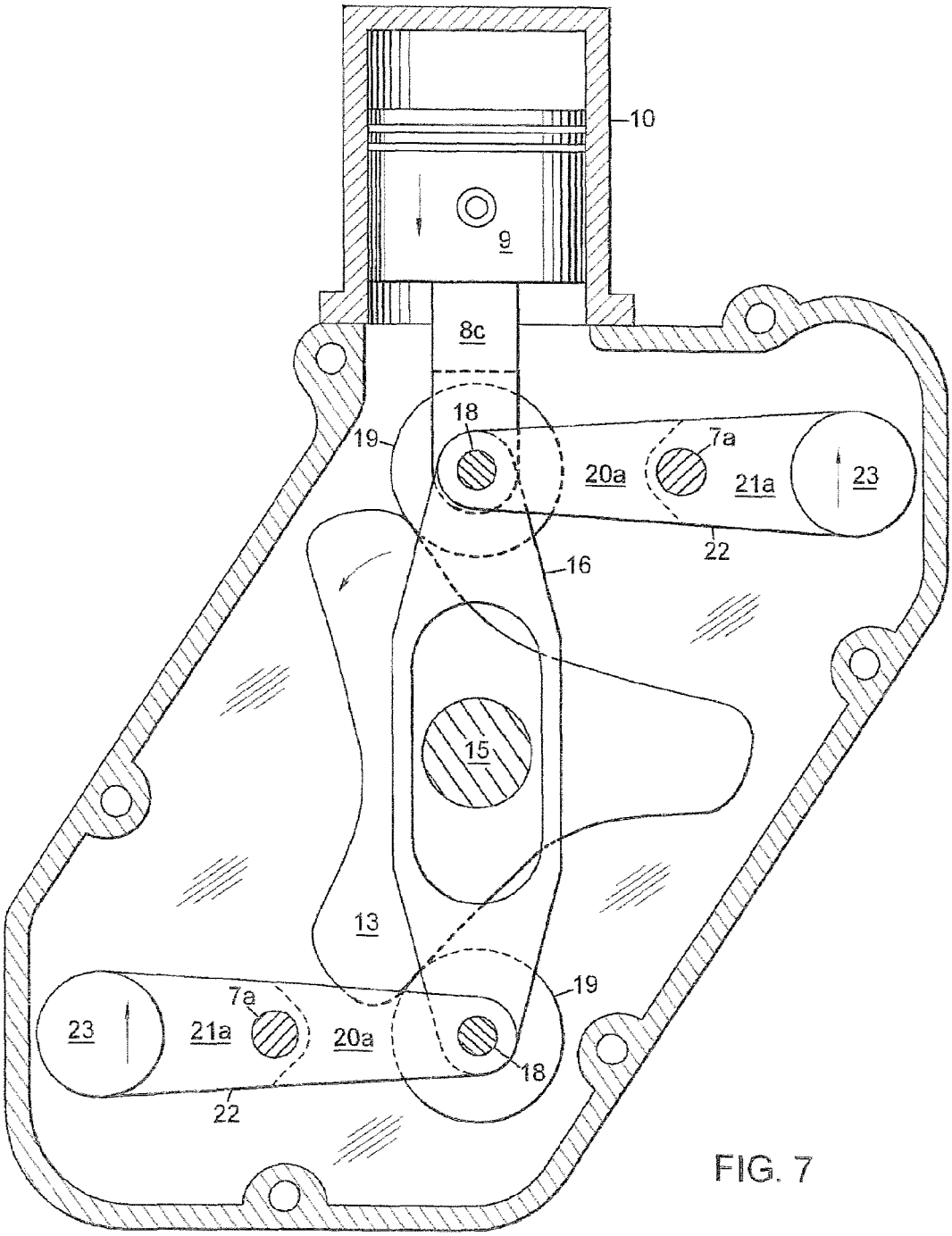
FIG. 7 shows a front sectional view of a single-cylinder, three-lobe cam, opposed beam mechanism where the opposite-direction extending beams have balancing weights attached.

In FIG. 7, there is shown a single-cylinder, odd-lobe cam, offset beam machine with opposed beams which is an alternative for the cam machine in FIG. 6. FIG. 7 is similar to FIG. 6 except the follower arms 20*a* are joined to balancing beam arms 21*a* at pivot pins 7*a*. The follower and beam arms comprise a pair of longitudinal opposite-direction extending rocker beams 22 with generally central pivotal axes that can be used for single-cylinder 10 or diametrically-opposed, two-cylinder (not shown) arrangements. Beam arms 21*a* include balancing weights 23 which provide offsetting inertia force balance for the centrally located piston 9, piston rod 8*c*, link pair 16, followers 19 and arms 20*a*. The balancing rocker beams oscillate slightly out of parallel which cause a small imbalance that can be minimized by using longer follower arms. The beam pair oscillates in unison and harmonically which enables more than 95% dynamic balance for gasoline engines and compressors. Some advantages are very low vibration for a single-cylinder machine, simple structure, low cost and the option of using a one or three-lobe cam.

Figures 8, 8A:
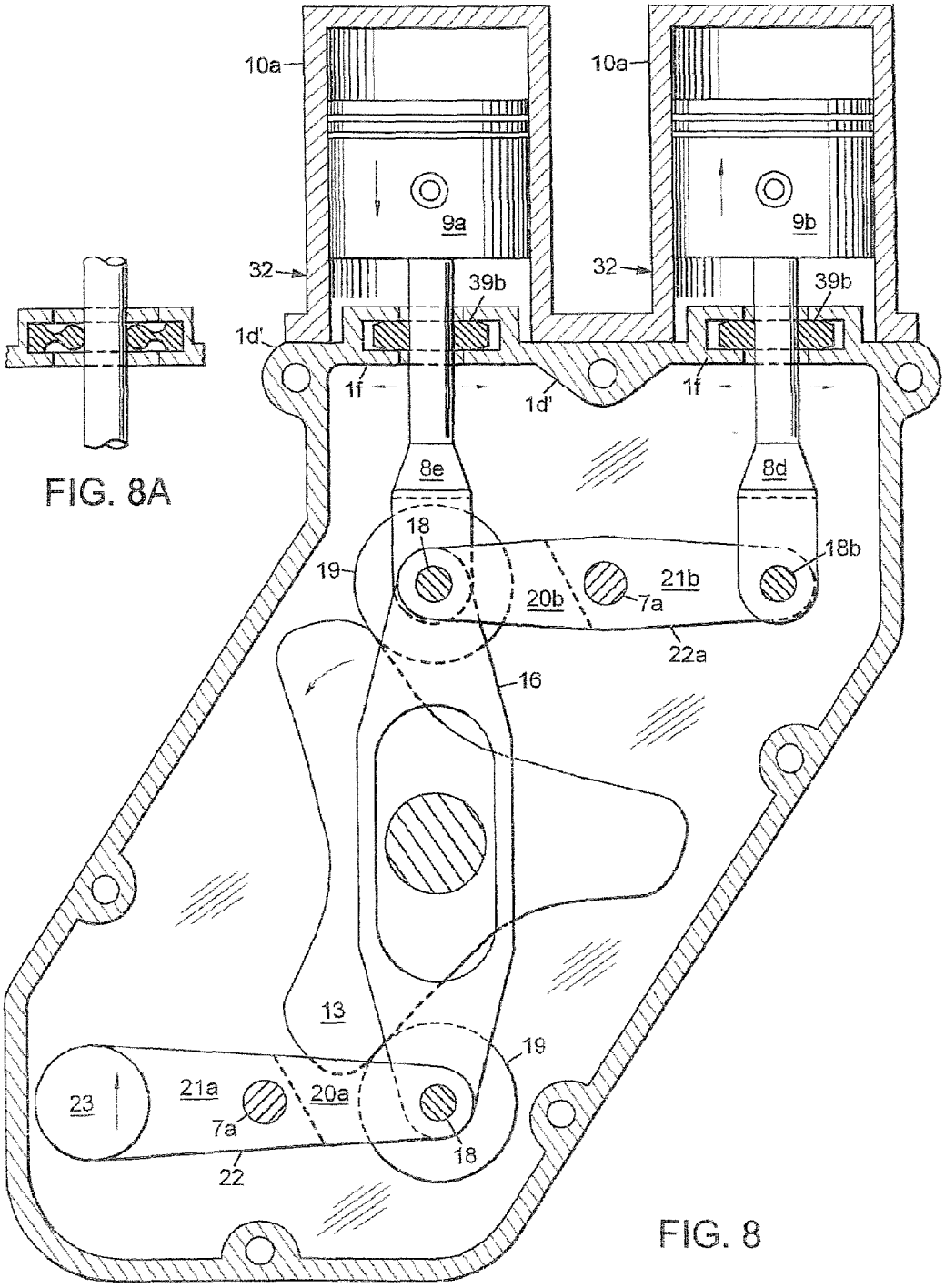
FIG. 8 shows a front sectional view of the cam beam mechanism that functions with in-line twin-cylinders.
FIG. 8A shows a front sectional view of an alternative piston rod seal.

In FIG. 8, there is shown a single row, in-line twin-cylinder 10*a*, cam beam arrangement which includes opposite-direction extending beams 22 & 22*a* similar to FIG. 7. The upper beam 22*a* is connected at opposite ends to pistons 9*a* & 9*b*. The upper beam arm 21*b* is connected to piston rod 8*d* by a piston rod pin 18*b*. Rod 8*d* is connected to an additional outer piston 9*b*. This outer piston and balancing weight 23 provide dynamic balance for the centrally located piston 9*a*, rod 8*e* and other associated moving components. The FIG. 8 arrangement has less offsetting inertia forces than a diametrically-opposed, two-cylinder (not shown) beam arrangement because the outer piston 9*b* is used as an offsetting weight for the central components, thereby reducing inertia forces about 35%.

An alternative sliding rod seal 39*b* (alternative to seals described in FIGS. 1B & 5) is positioned around each rod 8*d* & 8*e*, wherein each sliding seal is contained within the guide plate's 1*f* seal slot located in camcase head 1*d'*. For seals made of metal or hard plastic, a convex inner diameter seal surface is preferred to allow clearance for the slight rod oscillation. This will maintain a close circular contact between the seal and rod.

For another alternative rod seal (shown in FIG. 8A), the seal's outer section is supported in a fixed position by the camcase (or crankcase). The seal's flexible inner section compensates for slight piston rod lateral movements while maintaining a snug fit around the rod.

For 2-stroke applications, FIG. 8 provides low cost, low weight, low emissions and 180° alternating power strokes. This low vibration beam arrangement eliminates the poor balance typical of conventional in-line, twin-cylinder engines.

Figure 9:
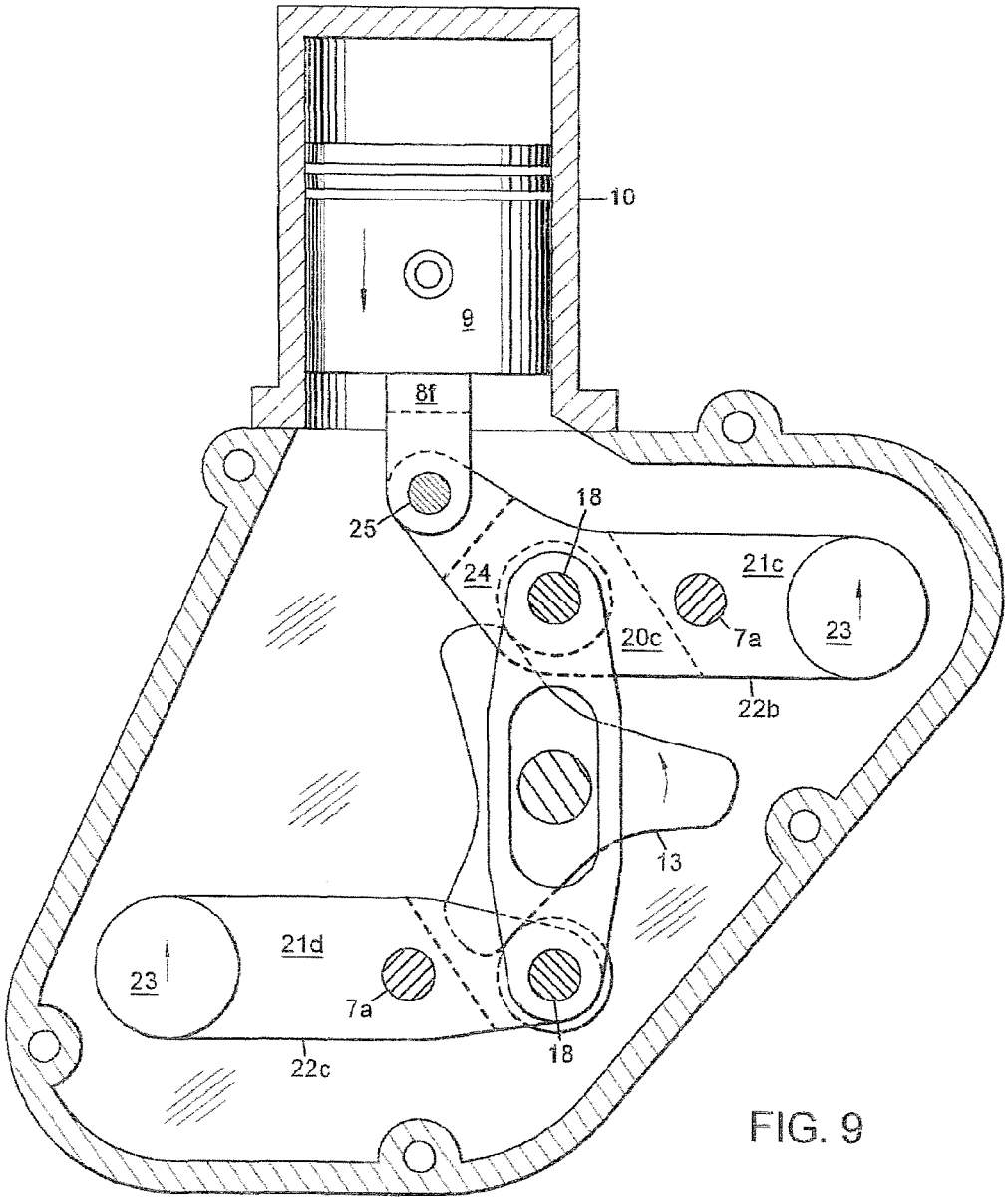
FIG. 9 is similar to FIG. 7 with the addition of a lever arm that extends outward from the beam's follower arm for connection to the piston.

In FIG. 9, there is shown a single-cylinder, lever arm cam beam arrangement including two beams 22*b* & 22*c* with the upper beam 22*b* configured to include the addition of lever arm 24. The lever arm beam 22*b* is comprised of lever arm 24 that extends outward from the follower and in an opposite direction from the adjoining follower arm 20*c*, beam arm 21*c* and balancing weight 23. The lever arm has a pinhole at its outer end that supports lever pin 25; pin 25 is connected to the lower end of piston rod 8*f* that connects to piston 9. This mechanism can operate with an opposed lever arm beam and corresponding opposed rod and piston (not shown). FIG. 9 includes balancing beam arms 21*c* & 21*d* with balancing weights 23 for providing dynamic balance.

Figure 15:
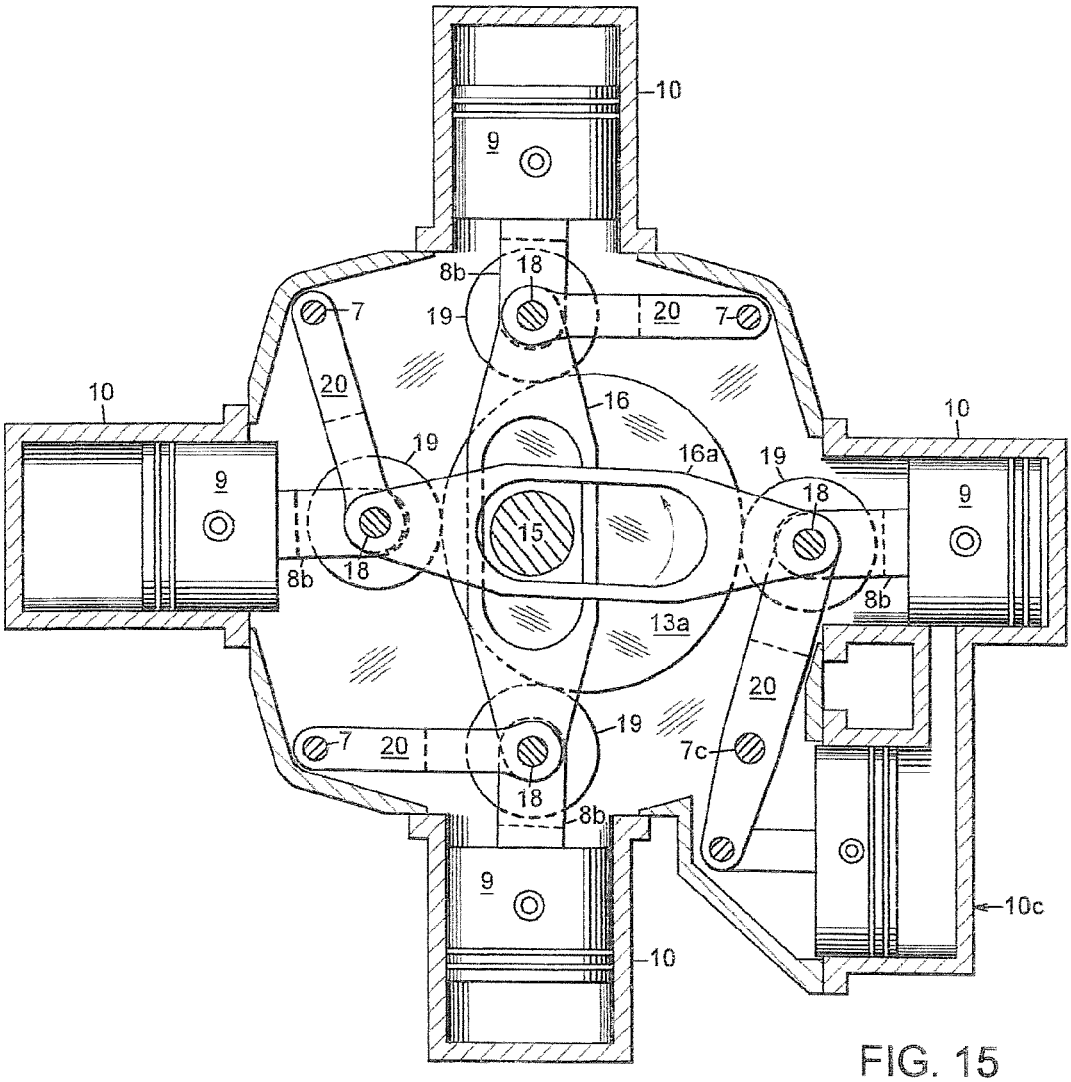
FIG. 15 shows a front sectional view of a four-cylinder radial, one-lobe cam machine with two pairs of intersecting links and one charger cylinder (for 2-stroke applications) to illustrate.

Relocating the lever pin 25 outward from the axis of the follower arm will increase piston dwell by changing the position of the "dwell arc" (ref. FIG. 2). Also, increasing the length of the lever arm 24 provides a longer stroke for additional power. Advantages of the FIG. 9 configuration (compared to FIG. 7) are compact size and less weight for a given stroke. For 2-stroke operation, FIG. 9 can be fitted with an under-piston pump or a charger cylinder 10*c* as illustrated in FIG. 15. Using three-lobe cam 13 eliminates a transmission for engine applications that operate compressors.

For an alternative, beam arms 21*c* & 21*d* can be eliminated to achieve compactness. This reconfigured version requires a one-lobe cam with counterweights and has more vibration, but results in less reciprocating forces on the roller cam followers.

Figure 10:
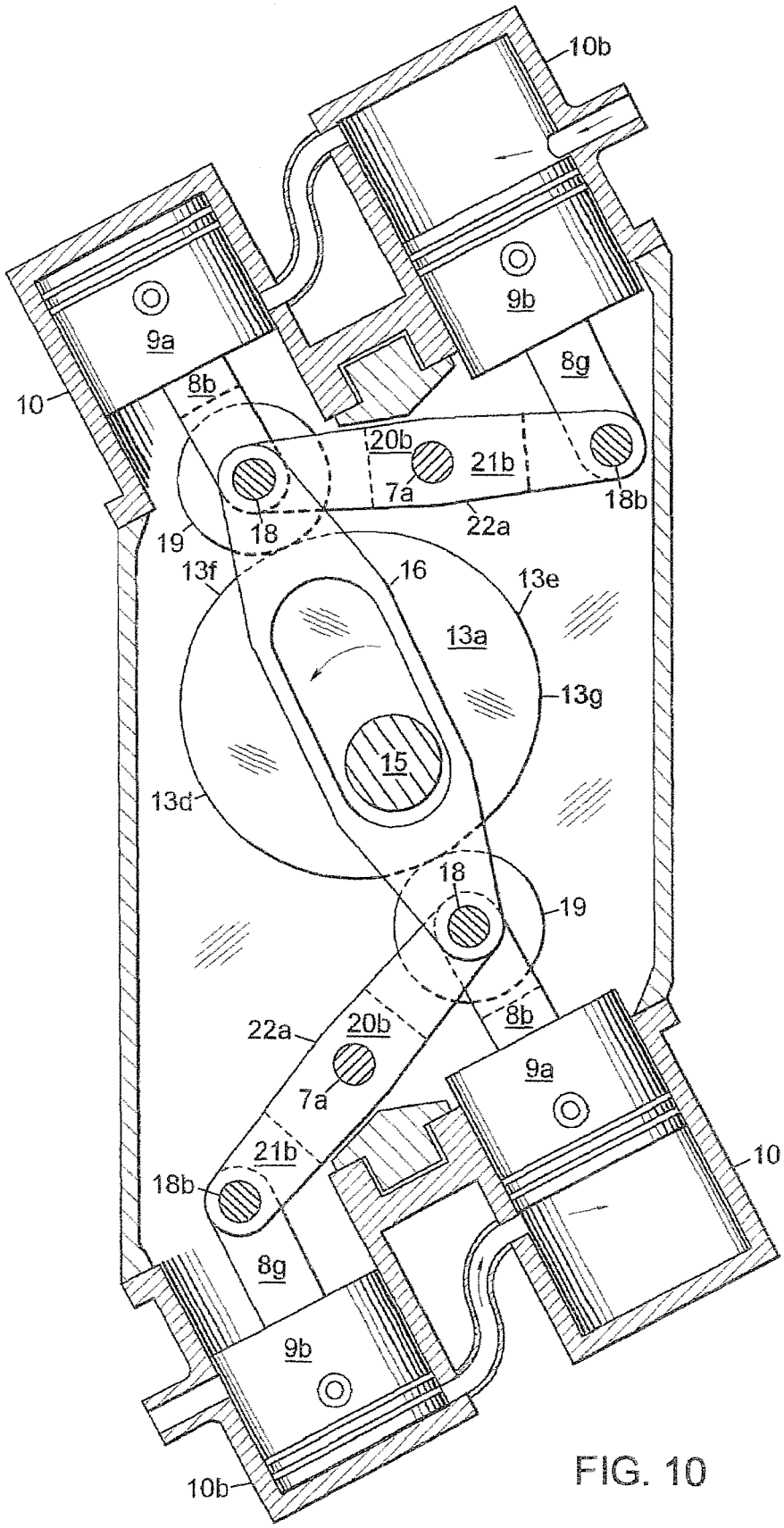
FIG. 10 shows a front sectional view of a four-cylinder, one-lobe cam, opposed beam mechanism using two power cylinders and two charger cylinders.

In FIG. 10, there is shown a four-cylinder, disk cam offset-beam arrangement. Similar to FIGS. 7-9, FIG. 10 uses offset balance beams 22*a* which consist of balancing beam aims 21*b* joined to cam follower arms 20*b*. Arranged with diametrically-opposed power cylinders 10 and a one-lobe cam 13*a* (three or five-lobe optional), this piston machine uses connecting rods 8*g*, pistons 9*b* and cylinders 10*b* for charging. Charger pistons 9*b* are positioned adjacent to diametrically-opposed pistons 9*a*. Piston rods 8*b* are connected at their lower end to follower pins 18 with the opposite end of rods 8*b* connected to opposed pistons 9*a*. Beam arms 21*b* have pinholes positioned at their outer ends for supporting a pair of piston rod pins 18*b* which are connected to the pair of piston rods 8*g*.

For longer piston dwell at TDC and improved fuel economy, the one-lobe disk cam's profile incorporates an asymmetrical design. The cam's track profile consists of a generally semicircular follower track surface 13*d* on one side of the disk cam and irregular raised track surface 13*e* on the opposite side of the cam. Camshaft 15 is generally located on the center line dividing the semicircular track surface 13*d* and the irregular track surface 13*e* and offset towards the portion of the irregular track with the maximum raised surface 13*g*. Opposite camshaft 15 is located the top 13*f* of the cam lobe.

When using charger cylinders 10*b*, the FIG. 10 cam mechanism provides simple structure and low cost for 2-stroke engines. As an option, this machine can operate with four power cylinders using under-piston scavenging pumps. This arrangement configured as a 2-stroke engine provides more than 97% dynamic balance while achieving higher efficiencies when compared to 4-stroke, four-cylinder, conventional crankshaft engines. This beam arrangement also provides alternating power strokes, smooth torque and low cost.

Figure 11:
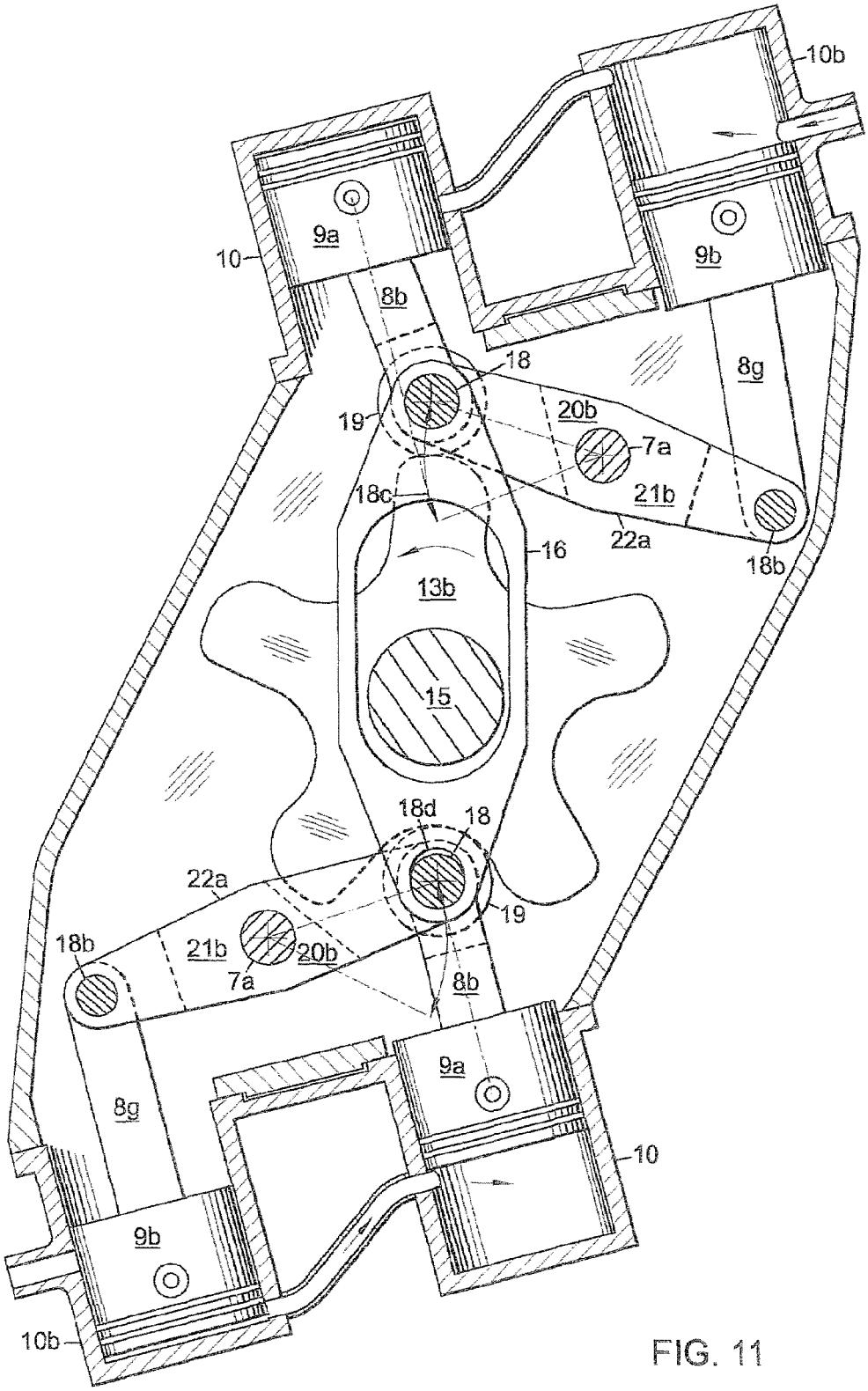
FIG. 11 is similar to FIG. 10 except a five-lobe rather than a one-lobe cam is shown.

In FIG. 11, there is shown a four-cylinder, cam offset-beam arrangement that is similar to FIG. 10, but incorporates a five-lobe cam option for reducing the camshaft 15 rpm per cycle rate. For tiltrotor aircraft and helicopter applications, a five-lobe cam engine will eliminate reduction gears for powering a prop.

The FIG. 11 five-lobe cam 13*b* profile is designed for near maximum piston dwell. However, the cylinder 10 position, as shown, provides additional piston dwell because the cylinder axis is generally tangent to the lower section 18*c* of the arc defined by the motion of the follower pin 18 (piston rod pin). A substantial increased piston dwell is achieved since piston rod 8*b* moves towards the cylinder axis during the downward stroke, thereby slowing the piston's downward movement. This total dwell increase is significantly more than prior art cam engines yoke crankshaft engines and conventional crankshaft engines.

For an opposed-piston (FIG. 11) or in-line twin-cylinder, cam beam (FIG. 8) configuration, sliding friction of the roller followers 19 on the cam can be reduced by incorporating at least one slightly oblong link pinhole 18*d*. This allows longer continuous contact of the followers on the cam providing less slippage.

Figure 12:
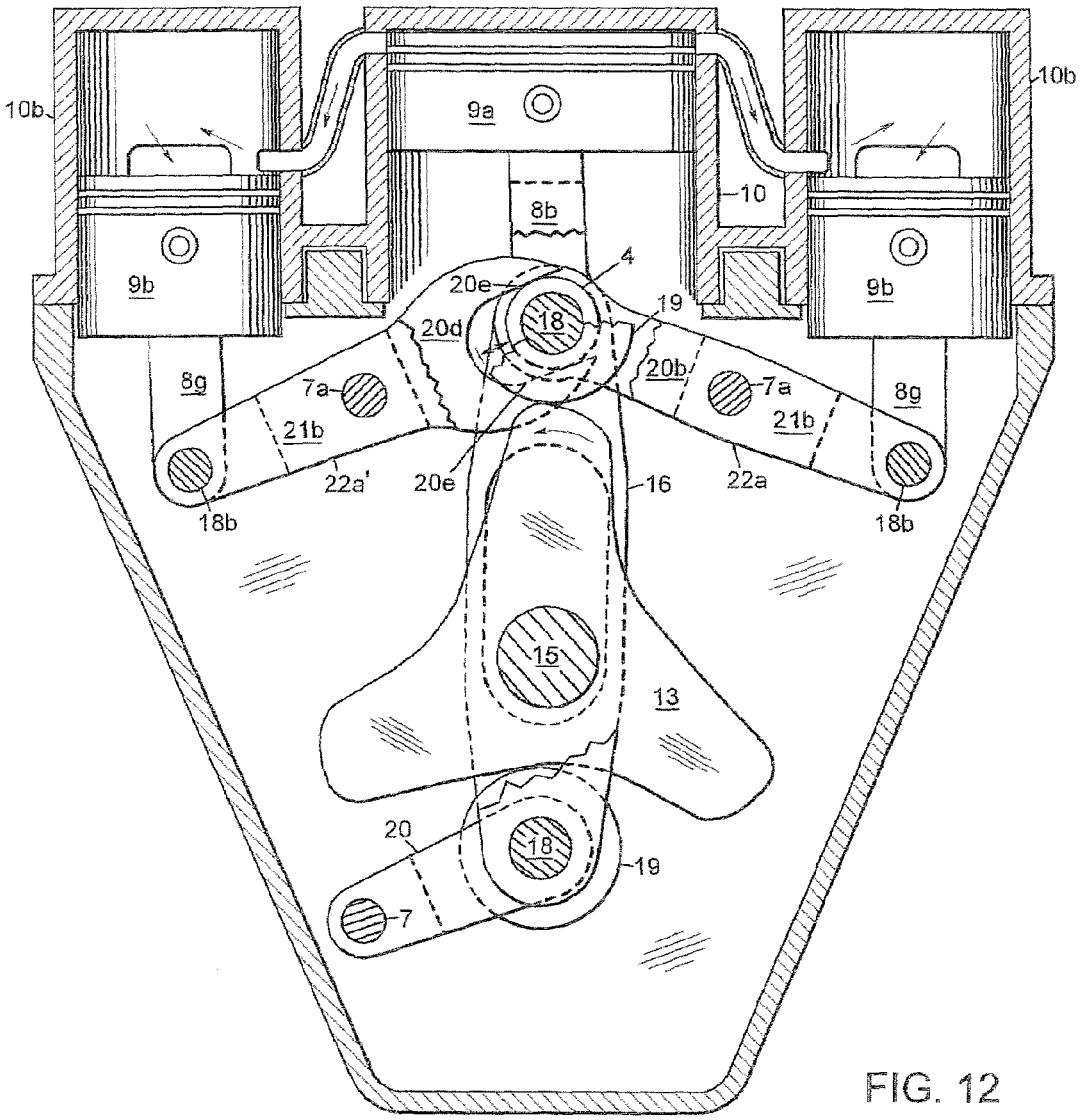
FIG. 12 shows a front sectional view of a three-cylinder, three-lobe cam beam mechanism with the beams located on one side of the cam, one beam having a dual forked end with bearing surfaces to carry the second beam's rod pin bearing for reciprocation within the dual forked slots.

In FIG. 12, there is shown an alternative three-cylinder, three-lobe cam (one or five-lobe optional) offset-beam machine. A first balancing beam arm 21*b* extends from the pivot end of a first link follower arm 20*b* providing a first rocker beam 22*a* having a central pivot axis 7*a*. A second balancing beam arm 21*b* extends from the pivot end of a second link follower arm providing a second rocker beam 22*a'* having a central pivot axis 7*a*. The first and second balancing rocker beams extend in generally opposite directions. The centrally located forked end (two prongs) of the first rocker beam 22*a* has a pinhole through each prong that the follower pin 18 (also, beam pin) passes through. The follower arm of the second rocker beam 22*a'* has two branches with each branch 20*d* having a two-prong forked end. Each forked end has a pair of generally parallel track surfaces 20*e* forming a bearing slot with the track surfaces generally parallel to the longitudinal axis of the second rocker beam 22*a'*. Follower pin 18 also passes through links 16 and the pair of bearing slots within the forked ends; follower pin 18 reciprocates within the bearing slots as the beam 22*a'* oscillates. Follower pin 18 connects to one end of piston rod 8*b*, and the opposite end of piston rod 8*b* connects to centrally located piston 9*a*. To reduce friction, a pair of optional slot bearings 4 can be fitted around follower pin 18. Beam arms 21*b* are connected to the lower ends of piston rods 8*g* by piston rod pins 18*b* with the opposite ends of rods 8*g* connected to pistons 9*b*. Pistons 9*b* are positioned on opposite sides of piston 9*a* providing an in-line arrangement.

For alternative pin placements (not shown), a second pin can be placed above follower pin 18 relocating the beam pair and piston rod on an extended link pair. A third pin can be added to accommodate just the beam pair or an individual beam with the other beam connected to the rod pin. Or, each beam can be attached to the links by individual pins for four total pin replacements. Accordingly, the follower arm connected to the link pair opposite end can be attached by an additional pin placed outward from the roller follower.

An alternative cylinder arrangement can be configured with one power piston connected to one of the beam arms with the opposite beam arm having an attached balancing weight. When arranged with only a centrally located power cylinder, balancing weights can be attached to both beam arms 21*b* to replace pistons 9*b*.

The FIG. 12 machine is configured as a 2-stroke cycle internal combustion engine. For 4-stroke operation, a one-lobe cam is required. The centrally located cylinder 10 provides a charger for charging beam arm power cylinders 10*b*, although for some applications, cylinders 10*b* can be used to charge centrally located cylinder 10. As an option, under-piston pumps can be used for charging. For an alternative mechanism, a third and fourth rocker beam can be positioned on the opposite side of the cam opposing the first and second rocker beams for a six-cylinder arrangement. The advantages of FIG. 12 are compact design, excellent dynamic balance and low cost 2-stroke operation.

Figure 12A:
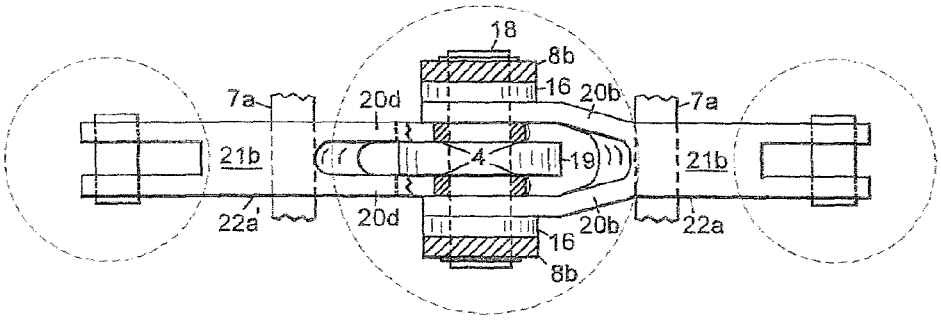
FIG. 12A is a top sectional view of FIG. 12.

In FIG. 12A, there is shown a top sectional view of FIG. 12.

Figure 13:
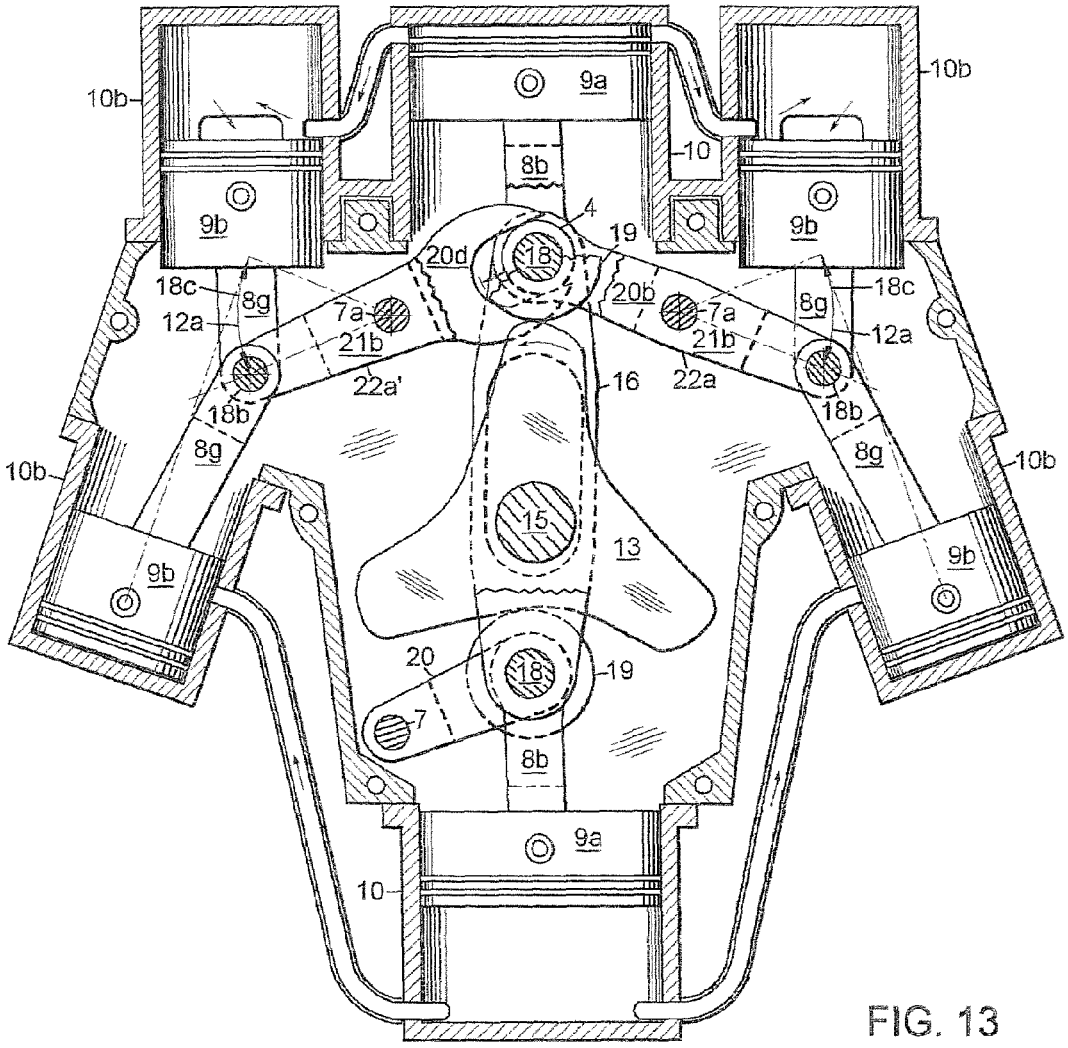
FIG. 13 is similar to FIG. 12 except with the addition of three similar opposing cylinders.

In FIG. 13, there is shown a modified FIG. 12 to include an additional pair of pistons 9*b* opposite the first pair of pistons 9*b*. Each added piston is connected to its respective beam arm 21*b* and rocker beams 22*a* & 22*a'*. A second charger cylinder 10 is positioned opposite the first charger cylinder 10 and connected to the opposite ends of links 16. The advantages of FIG. 13 are simple structure for six-cylinder arrangements, excellent dynamic balance and low cost 2-stroke operation.

Figure 14:
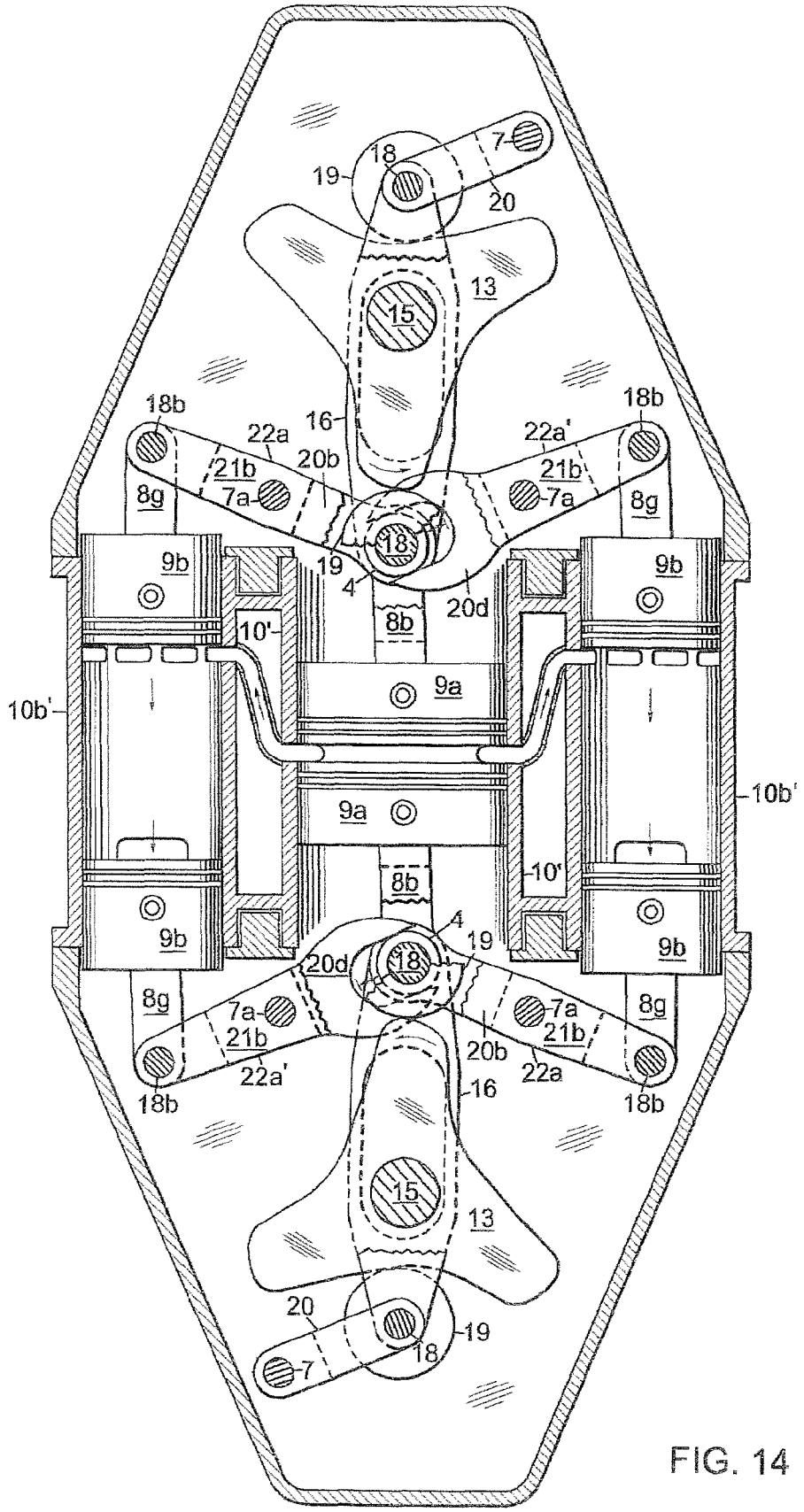
FIG. 14 shows two FIG. 12 arrangements joined together for providing a 2-stroke double-opposed-piston mechanism.

In FIG. 14, there is shown a 2-stroke cycle internal combustion engine of the double opposed-piston type which operates with two opposed cam 13 linkages—the same linkage discussed and illustrated in FIG. 12. The camshafts 15 of the opposed linkages are typically connected by a gear train (not shown). Cam linkages are connected to centrally located double opposed-pistons 9*a* & 9*b* contained within their corresponding cylinders 10' & 10*b'*.

In FIG. 15, there is shown a four-cylinder, one-lobe disk cam 13*a* radial cylinder arrangement that requires camshaft counterweights. This linking arms mechanism includes a second pair of parallel links 16*a* that intersect at a 90° angle with the first pair of links 16. The second pair of links 16*a* is positioned outside the first pair 16. The opposite ends of links 16*a* are attached to a pair of follower pins 18 that are connected to a pair of opposed cam followers 19 and follower arms 20. For an alternative follower arm arrangement, adjacent follower arm pairs can be connected (siamesed) to the same pivot pin, thereby eliminating two pivot pins. Follower pins 18 connect to piston rods 8*b* that connect to pistons 9. This mechanism can also operate with semiradial three-cylinders or V-twin cylinders (not shown). There is the option of using charger cylinders 10*c* (shown for only one piston to illustrate) or under-piston scavenging pumps (not shown) for 2-stroke operation. FIG. 15, in general, has lower vibration compared to conventional radials which have poor piston rod dynamic balance. For one or three-lobe cam applications. FIG. 15 can be configured with four unit-rows to provide offsetting inertia forces for dynamic balance.

Figure 16:
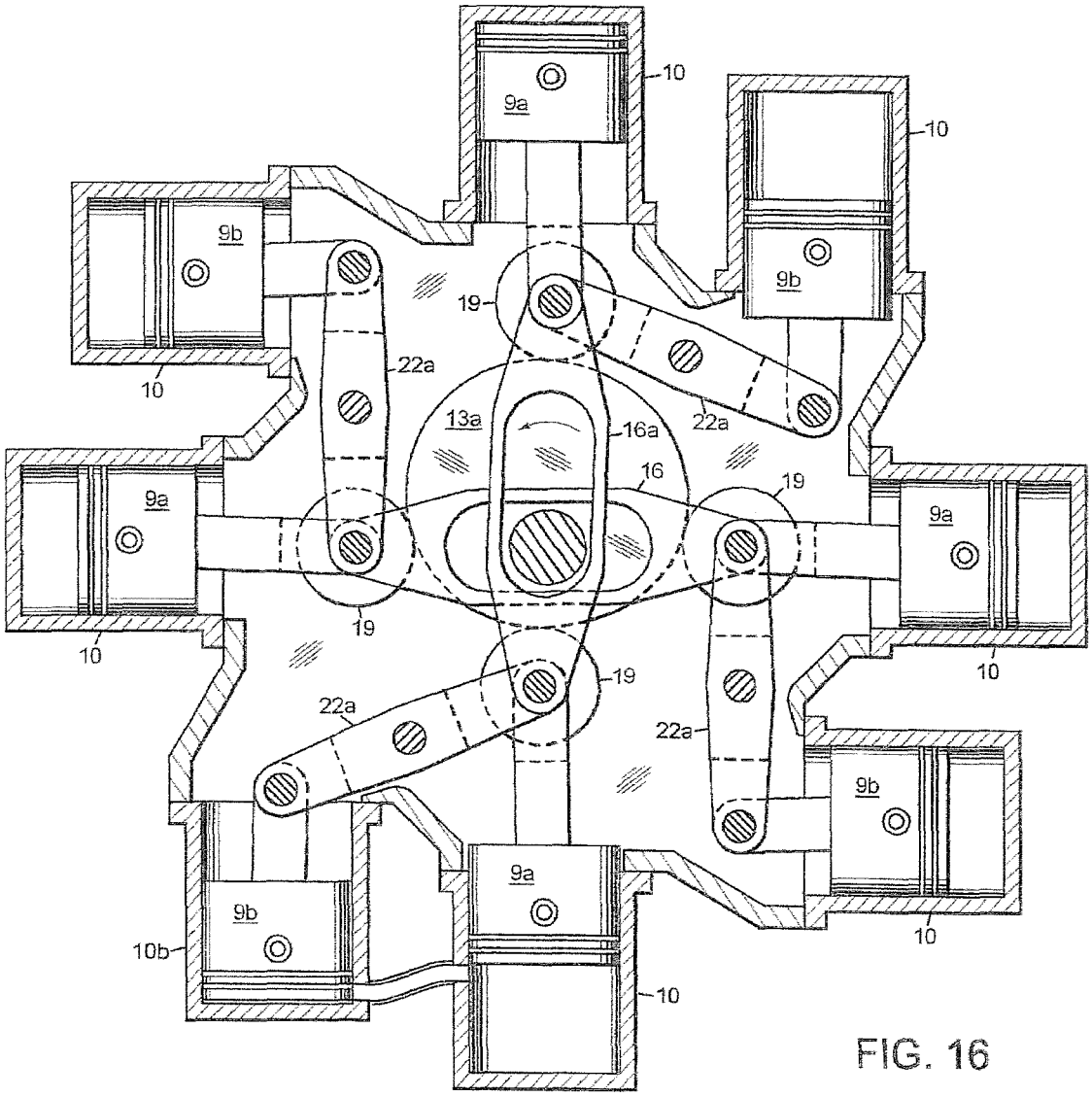
FIG. 16 shows a front sectional view of an eight-cylinder radial, one-lobe cam beam machine using two pairs of intersecting links connected to four roller followers and four beams.

In FIG. 16, there is shown an eight-cylinder radial, beam arrangement which includes two pairs of offset-beams positioned in the same rotary direction about one-lobe disk cam 13*a*. FIG. 16 is an extended version of FIG. 10, wherein two FIG. 10 configurations are arranged perpendicular without adding a second cam. For one, three or five lobe cams, the single row FIG. 16 arrangement has dynamic balance.

Figure 17:
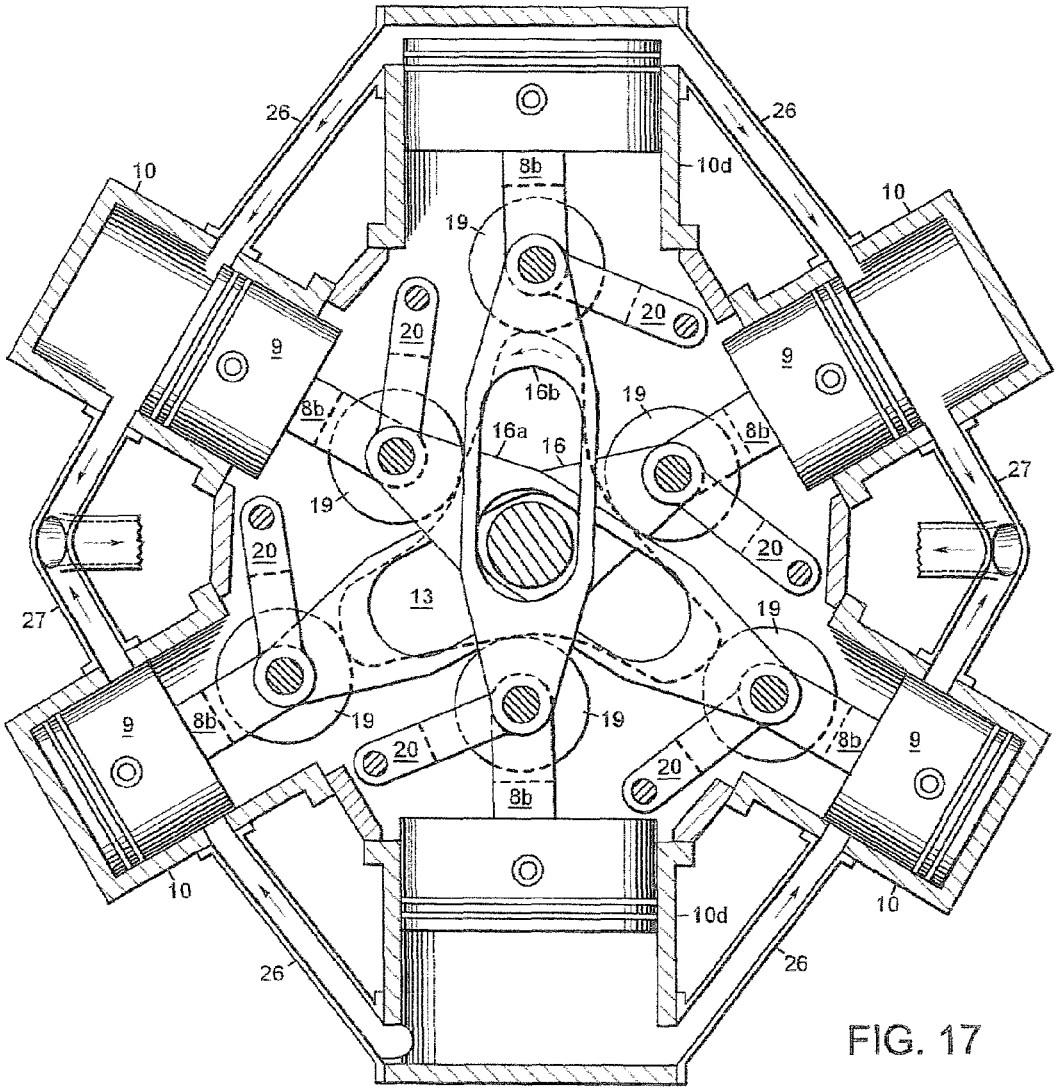
FIG. 17 shows a front sectional view of a six-cylinder radial, three-lobe cam machine using three pairs of intersecting links connected to six roller followers and six pivot arms, two opposed charger cylinders (for 2-stroke applications) provide charging for four power cylinders.

In FIG. 17, there is shown a three-lobe cam, six-cylinder radial arrangement which operates with three intersecting pairs of parallel links 16, 16*a* & 16*b* that link opposing followers, follower arms and pistons. This arrangement shows a self-supercharged, 2-stroke cycle engine operating with two opposed, single-acting charger cylinders 10*d* and four opposed power cylinders 10. Under-piston scavenging pumps (not shown) can be used as an alternative to the charger cylinders. Air transfer pipes 26 connect charger cylinders 10*d* to adjacent power cylinders 10 while exhaust manifolds 27 are positioned between power cylinders 10. This piston machine can also operate as a semiradial, three-cylinder engine (not shown) consisting of two power pistons 9 that reciprocate in unison. As with the six-cylinder radial. cylinders 10 are charged by the centrally located third piston. For an alternative, converting this arrangement to a three power piston radial (wherein, replacing the charger cylinder with a power cylinder) allows the use of camcase compression, but with a significant loss in volumetric efficiency. A three-lobe cam is shown in FIG. 17 although a one-lobe cam can be used with under-piston scavenging pumps, or pulse bottles can be fitted to the charger cylinders 10*d*. The one-lobe cam requires camshaft counterweights for balance. Three-lobe cam arrangements provide offsetting reciprocating components for dynamic balance and do not require counterweights. For FIG. 17, both the one and three-lobe cam arrangements provide over 98% dynamic balance.

Figure 18:
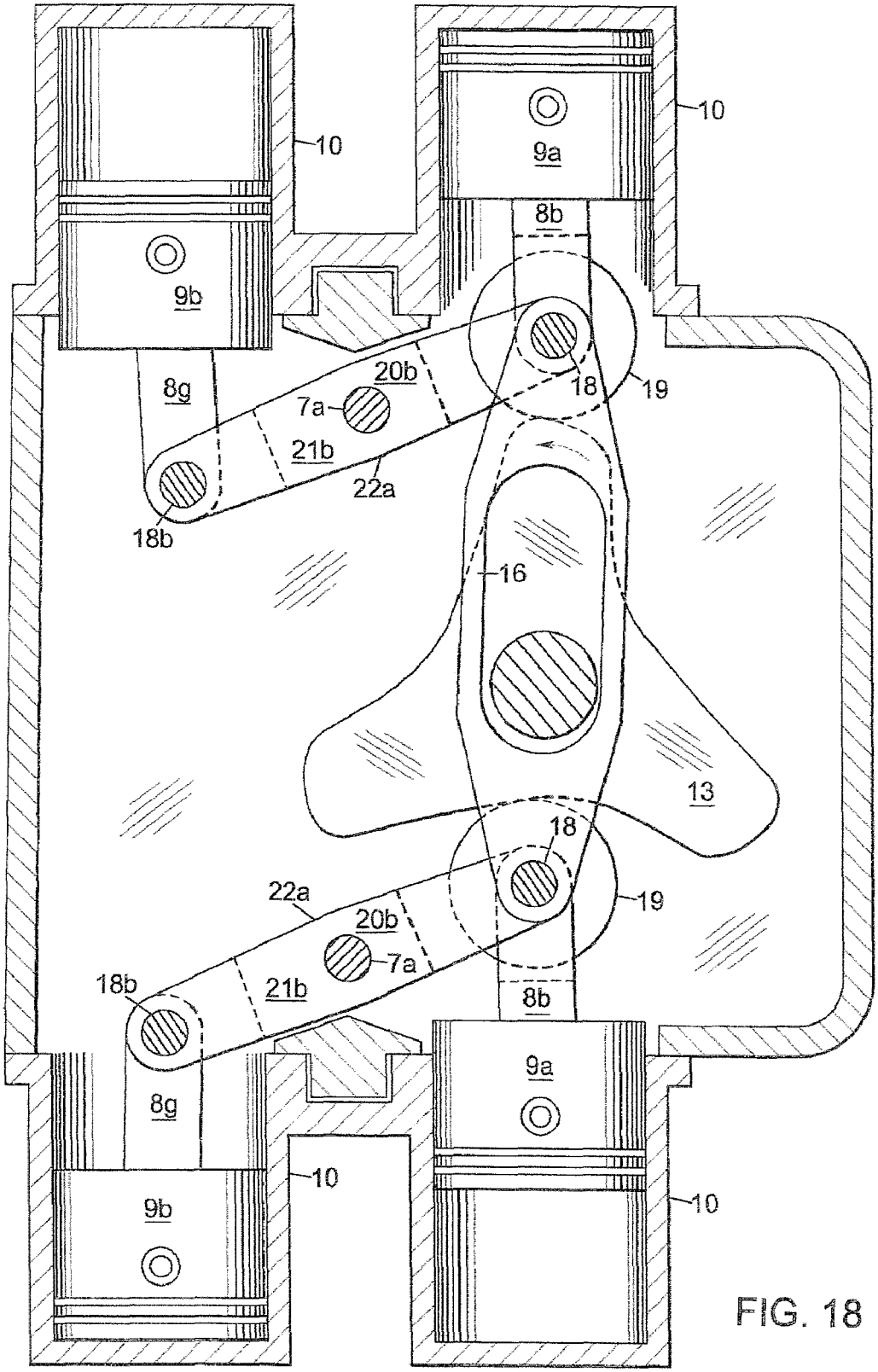
FIG. 18 shows a front sectional view of a one row, diametrically-opposed four-cylinder, three-lobe cam beam arrangement.

In FIG. 18, there is shown a multicylinder cam beam alternative which operates with four rows (not shown) and four in-line banks of diametrically-opposed cylinders that provide offsetting inertia forces for dynamic balance. Centrally located two rows (not shown) reciprocate in the opposite direction relative to the two outside rows. The pairs of beams 22*a* oscillate generally parallel and directly opposed which allow this cam beam mechanism to provide approximately 99% dynamic balance. A one-lobe, five-lobe (both not shown) or three-lobe cam 13 can be used in this arrangement to accommodate a variety of applications. As an alternative, follower arm links 16 can be relocated to the ends of beam arms 21*b*, but the preferable position is shown in FIG. 18. The FIG. 18 arrangement promotes compact design and offers relatively easy access to components for inspection.

Published test data have proven over the years that properly manufactured cam engines are reliable with long life intervals, and the wear on the cam and rollers due to sliding on the cam track is not significant. For 2-stroke, diametrically-opposed cam engines of the invention, cam followers have some sliding on the cam track near the top of the compression stroke at higher rpm. For very long life engine requirements, such as diesel applications, increasing the cam follower contact interval with the cam during the compression stroke will minimize "hop duration" and sliding wear. At least one end of the link pair pinholes can be slightly elongated (approx. 0.003"-0.005") in the longitudinal direction of the links to decrease roller follower hop. During the compression stroke, the adjusted link pinhole size allows the inertia forces to maintain roller follower contact with the cam, thereby minimizing follower sliding wear caused by unequal follower and cam track contact speeds.

Figure 19:
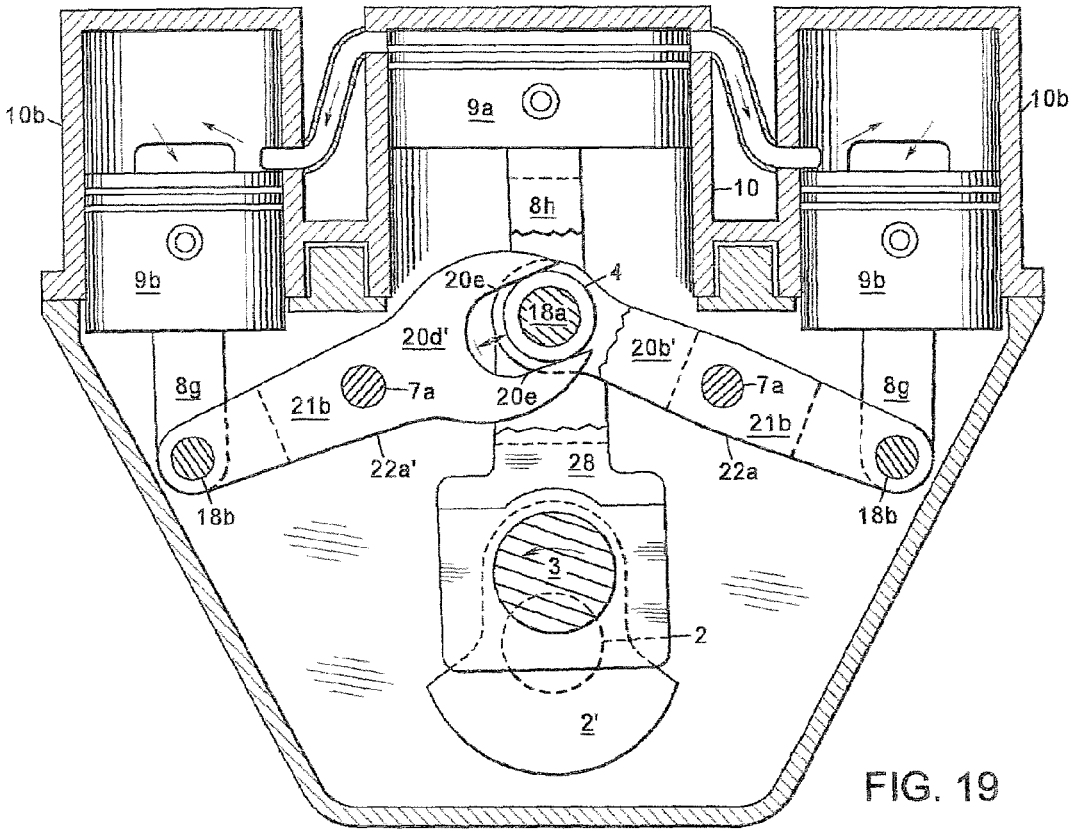
FIG. 19 shows a front sectional view of a three-cylinder, crankshaft rocker beam mechanism with the beams located on one side of the crankshaft, one beam having a forked end with hearing surfaces to carry the second beam's rod pin bearing for reciprocation within the forked slot.
Figure 20:
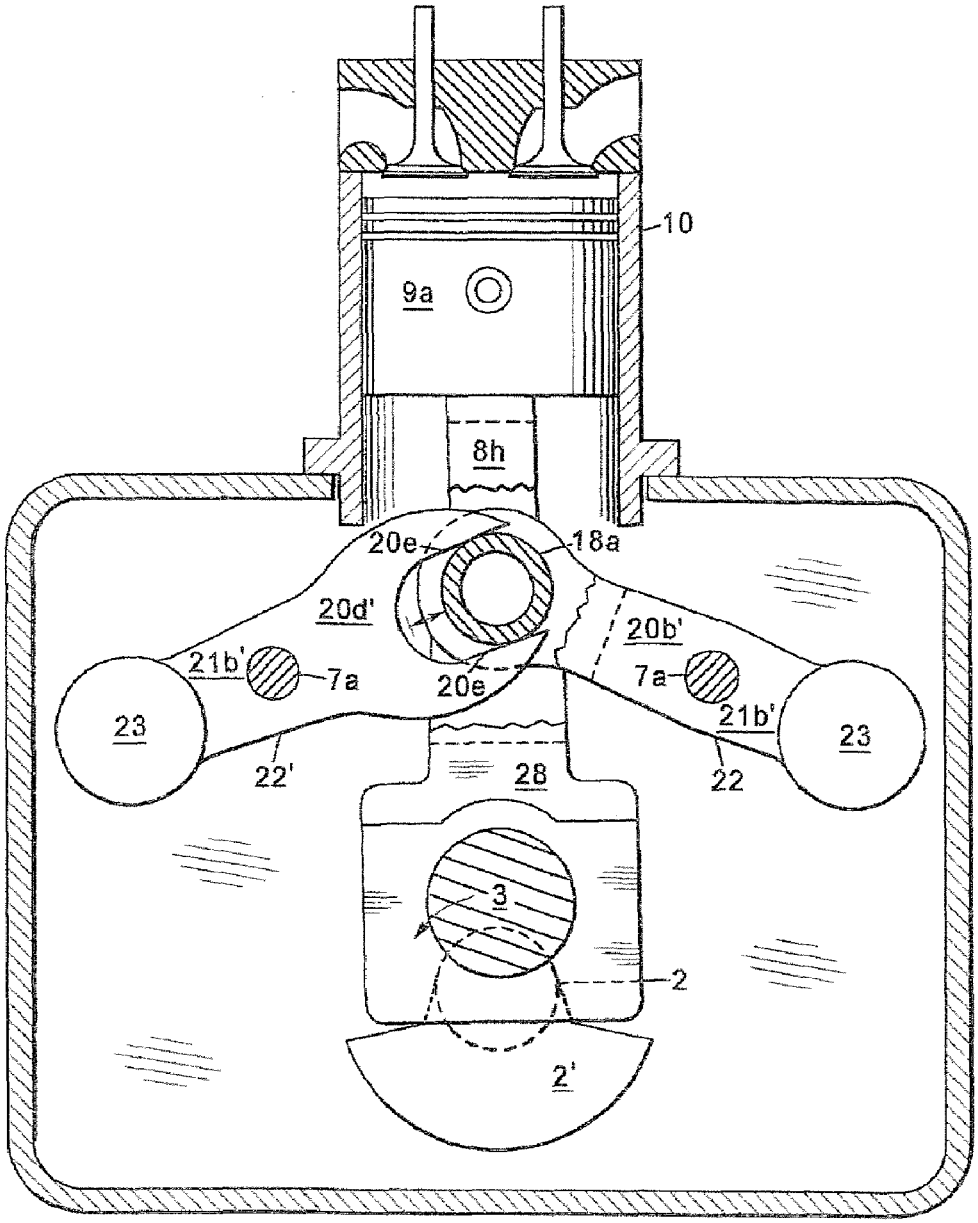
FIG. 20 is similar to FIG. 19 except configured as a single-cylinder with beam balancing weights to replace the outer pistons.
Figure 21:
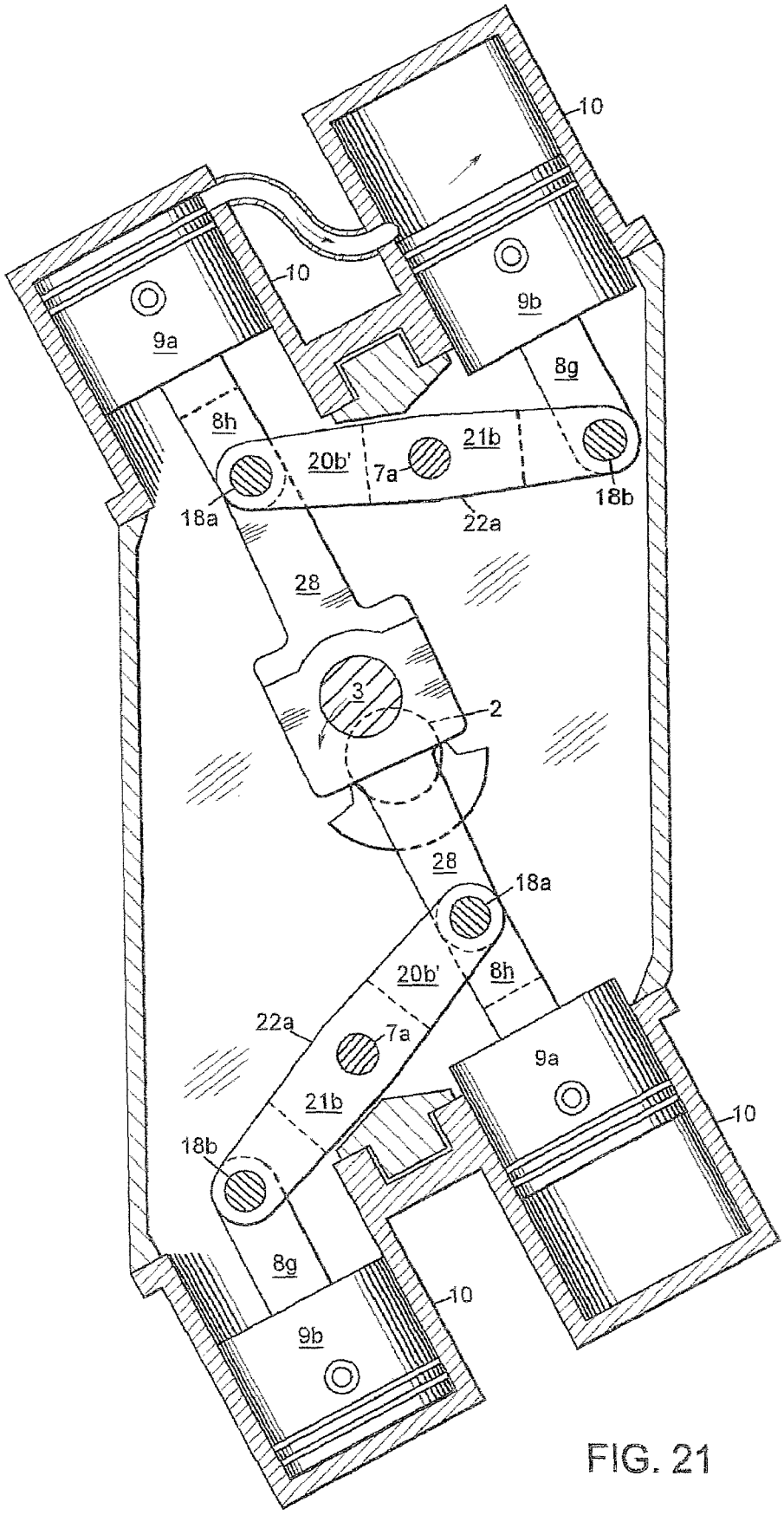
FIG. 21 shows a front sectional view of a four-cylinder, crankshaft beam arrangement with opposite-direction extending and opposed-beams.

In FIGS. 19-21, there are shown crankshaft beam arrangements. Simple structure (single- throw crankshaft) and increased piston dwell characterize these machines when compared to prior art. For the crankshaft beam, FIGS. 19-20 are the best choices for compactness and low vibration for engines, compressors and pumps.

In FIG. 19, there is shown another embodiment of the invention that is a three-cylinder, crankshaft offset-beam machine which is configured as a 2-stroke cycle internal combustion engine. Three in-line cylinders 10 & 10*b* are attached to the crankcase. The centrally located cylinder 10 provides a charger for charging power cylinders 10*b*; although for some applications, cylinders 10*b* can be used to charge the centrally located cylinder 10, but results in orthodox rod angularity which causes decreased piston dwell. As an alternative, under-piston pumps can be used for charging cylinders. FIG. 19, as an option, can also be configured for 4-stroke operation.

Balancing rocker beams 22*a* & 22*a'* extend in generally opposite directions and are positioned on the upper side of the crankshaft. Fixed pivot pins 7*a* connect the beams generally central pivotal axes to the crankcase. A single-throw crankshaft 2 with counter weight 2' is rotatably mounted in the crankcase with the lower end of beam connecting rod 28 pivotally connected to crankpin 3. The upper end of rod 28 is pivotally connected to the centrally located ends of rocker beams 22*a* & 22*a'* by a beam rod pin 18*a*. The centrally located forked end of the first beam 22*a* has a beam pinhole that the beam rod pin 18*a* passes through. The centrally located forked end of the second beam 22*a'* forms a bearing slot and a pair of parallel track surfaces 20*e* that beam rod pin 18*a* also passes through. The beam rod pin 18*a* reciprocates within the beam bearing slot in the general direction of the longitudinal axis of the second beam 22*a'*. The addition of slot bearing 4 reduces sliding friction. The ends of rod beam arms 20*b'* & 20*d'* are connected to beam rod pin 18*a* by a siamesed connection, although an alternative side-by-side connection or a fork (two double pronged forks) type connection can be used. Beam rod pin 18*a* connects to one end of piston rod 8*h*, and the opposite end of piston rod 8*h* connects to centrally located piston 9*a* which reciprocates within the centrally located cylinder 10. Piston rod pins 18*b* connect the lower ends of piston rods 8*g* to balancing beam arms 21*b*. The opposite ends of piston rods 8*g* are connected to outer pistons 9*b* which reciprocate within cylinders 10*b*. As options, the spacing of the piston rod 8*h* forked ends can be increased to fit on the outer ends of beam rod pin 18*a*, or beam rod 28 can be extended to allow a second pin placement (not shown) above pin 18*a* to separately connect piston rod 8*h*.

For an alternative, a third and fourth rocker beam can be added to the opposite side of the crankshaft opposing the first and second rocker beams for a six-cylinder arrangement. A second beam rod 28 connects the crankpin to the centrally located ends of the third and fourth rocker beams. This arrangement provides the advantages of very good dynamic balance and low cost.

An alternative cylinder arrangement for FIG. 19, similar to the FIG. 13 cam machine, incorporates an additional piston connected to each end of beam arms 21*b* with the option of a corresponding second charger cylinder 10 with its piston connected to crankpin 3. This six-cylinder arrangement provides simple structure, very good dynamic balance and low cost.

Another cylinder arrangement can be a 2-stroke cycle engine of the double opposed-piston type similar to FIG. 14, which in relation to FIG. 19, has crankshafts connected by a gear train or crankshaft connecting means.

The FIG. 19 novel crankshaft beam machine has the desirable features of very good dynamic balance and increased piston dwell which promote fuel economies and reduced emissions. Optimum piston dwell is achieved when pistons 9*b* serve as power pistons. When piston 9*a* serves as a power piston, piston rod 8*h* pushes beam rod 28 downward during combustion as in conventional engines causing orthodox beam rod 28 angularity and decreased piston dwell compared to dwell achieved through harmonic piston motion. In contrast, when outer pistons 9*b* serve as power pistons, beam rod 28 and crankpin 3 conversely are at the bottom position during combustion resulting in slower piston 9*b* acceleration during the piston power stroke and increased dwell compared to dwell achieved through harmonic piston motion. When compared to prior art conventional crankshaft beam (or conventional crankshaft) engines, FIG. 19 power pistons 9*b* inherently have about 25% increased piston dwell. By optimizing the position of the cylinder axis relative to the arc (ref. FIG. 13 12*a*) that is defined by the motion of the piston rod pin 18*b*, an additional dwell increase of 15% or more can be achieved for an overall dwell increase of more than 40%.

Figure 19A:
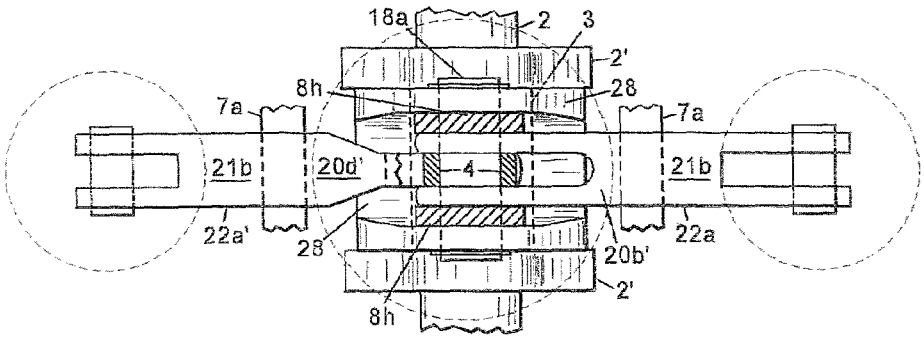
FIG. 19A is a top sectional view of FIG. 19.

In FIG. 19A, there is shown a top sectional view of FIG. 19.

In FIG. 20, there is shown an alternative single-cylinder, crankshaft offset-beam arrangement. A centrally located cylinder 10 and two pivoting beams 22 & 22' with attached balancing weights 23 make this low vibration, low cost arrangement ideally suited for small 4-stroke engine applications. A second piston can be connected to the end of one beam arm 21*b'* providing two power pistons for 4-stroke operation. For 2-stroke operation, a second piston can also be connected to one beam arm 21*b'* with either piston used as a charger or power piston. Also, under-piston pump(s) can be used for charging.

In FIG. 21, there is shown an alternative four-cylinder, crankshaft offset-beam machine. Similar to FIG. 10, FIG. 21 uses a pair of offset balancing rocker beams 22*a* which consist of balancing beam arms 21*b* joined to rod beam arms 20*b'*. Beams 22*a* are attached to the crankcase at their central pivotal axes by fixed pivot pins 7*a*. Single-throw crankshaft 2 has its crankpin 3 connected to opposite-direction extending beam rods 28 at their centrally located ends. Beam rod pins 18*a* connect the outer ends of the beam connecting rods 28 to the beam arms 20*b'* and piston rods 8*h;* these components all pivot about rod pins 18*a*. Beam rods 28 can be connected to the crankpin 3 by a side-by-side, dual fork or siamesed connection.

This crankshaft beam mechanism functionally operates somewhat similar to the cam beam mechanism (ref. FIG. 10) except for beam rod 28 angularity that causes secondary vibrations. Beam rod 28 angularity causes beam arms' 21*b* rocking motion to be dissimilar resulting in a rocking imbalance and machine vibrations. This rocking imbalance is minimized when increasing rod 28 length or when operating with a plurality of rows which promote offsetting inertia forces improving the dynamic balance. Also, beam rods 28 oscillate causing vibrations typical of conventional crankshaft machines. When using pistons 9*b* as power pistons, the FIG. 21 machine has about the same amount of increased piston dwell advantage as the invention's FIG. 10 cam machine and the FIG. 19 crankshaft arrangement. This translates to more than a 40% dwell increase when compared to conventional crankshaft beams or conventional crankshaft machines. Because of alternating power strokes, the FIG. 21 configuration provides the advantage of smooth torque.

In FIGS. 22-25, there are shown self-supercharging and self-aspirated engine arrangements of the invention. For both 2-stroke and 4-stroke cycle, each of these arrangements provide novel low-cost charging, crankcase air-fuel mixing, and the option of using crankcase oil or fuel-oil mist lubrication.

Figure 22:
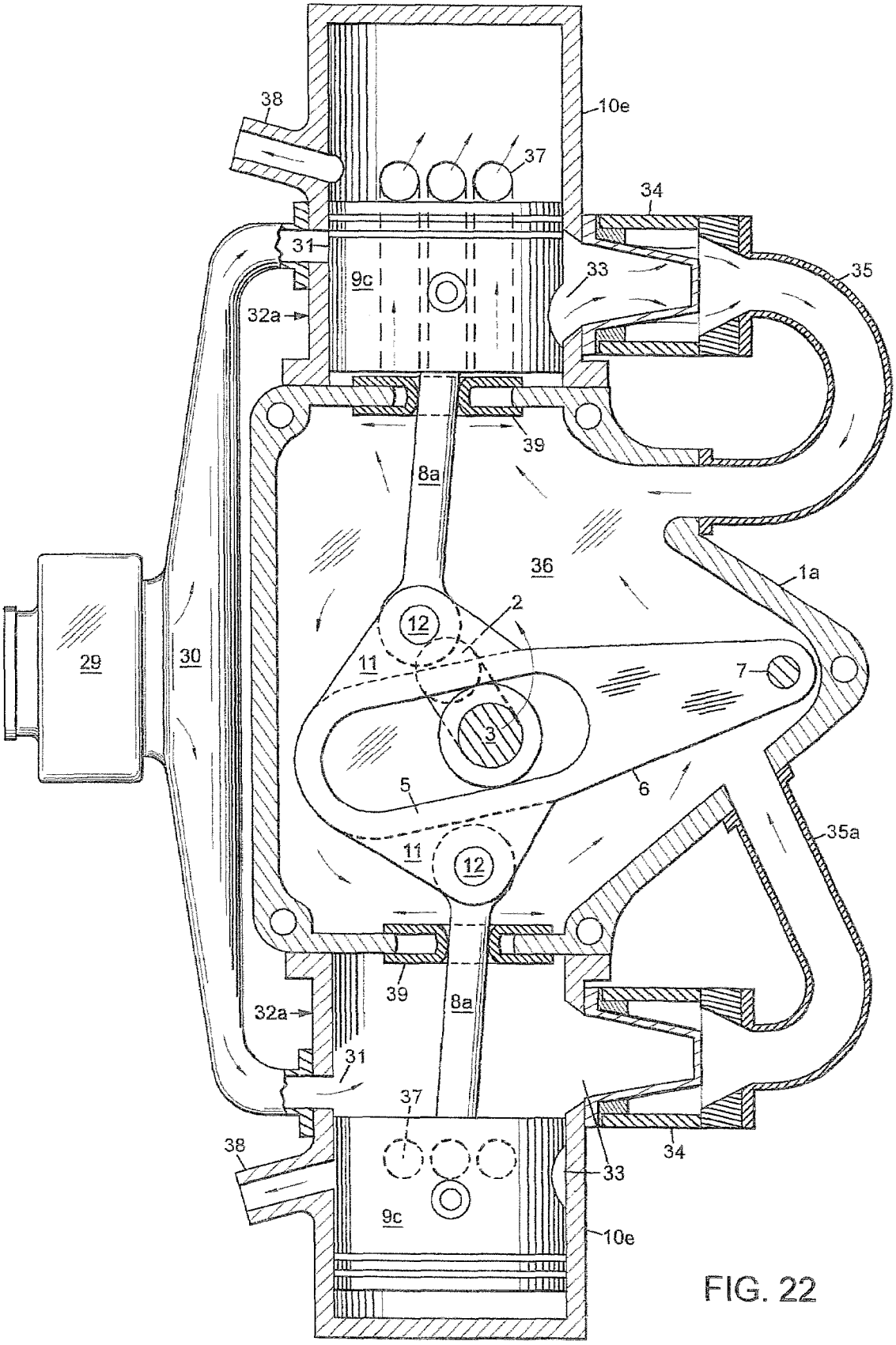
FIG. 22 shows a front sectional view of a 2-stroke, diametrically-opposed two-cylinder, self-aspirated, yoke-arm crankshaft engine which is charged by using a combination of under-piston pumps and crankcase compression.

In FIG. 22, there is shown a self-aspirated, 2-stroke cycle, two-cylinder diametrically-opposed engine. This configuration, an improvement compared to prior art, uses two pulse chambers for each cylinder consisting of an under-piston pump (pre-compression chamber) and a crankcase compression chamber.

As shown, a carburetor 29 is connected to intake manifold 30 that connects to under-piston intake ports 31 ($3^{rd}$ port). The charge is drawn through intake ports 31 into two opposed under-piston pumps 32*a* (first chamber) by the upward stroke of pistons 9*c*. During the downward stroke, pumps 32*a* compress air-fuel through pump piston ports 33 ($4^{th}$ port) which are located opposite the intake manifold. Pump ports 33 join to reed valves 34 from which the air-fuel charge flows through transfer pipes 35 & 35*a* to a crankcase compression chamber 36 (second chamber). This compressed air-fuel mixture, similar to conventional 2-stroke crankcase compression engines, is delivered from the crankcase compression chamber 36 through transfer ports 37 into the cylinder for combustion while assisting the exhaust flow through exhaust ports 38. Exhaust ports 38 can be repositioned for cross scavenging or relocated as exhaust poppet-valves in the heads. For a pump port 33 option, the reed valves can be eliminated, but increased lengths for cylinders 10*e* and pistons are required.

The FIG. 22 type of charging arrangement can also operate effectively with V or radial cylinder configurations. Turbulence within crankcase 1*a* provides excellent air- fuel mixing for lower emissions and increased fuel economy. Under-piston pumps 32*a* provide compressed air through the transfer pipes that enters the crankcase in the same direction as the crankcase circular flow promoting optimal charging and power.

Figure 23:
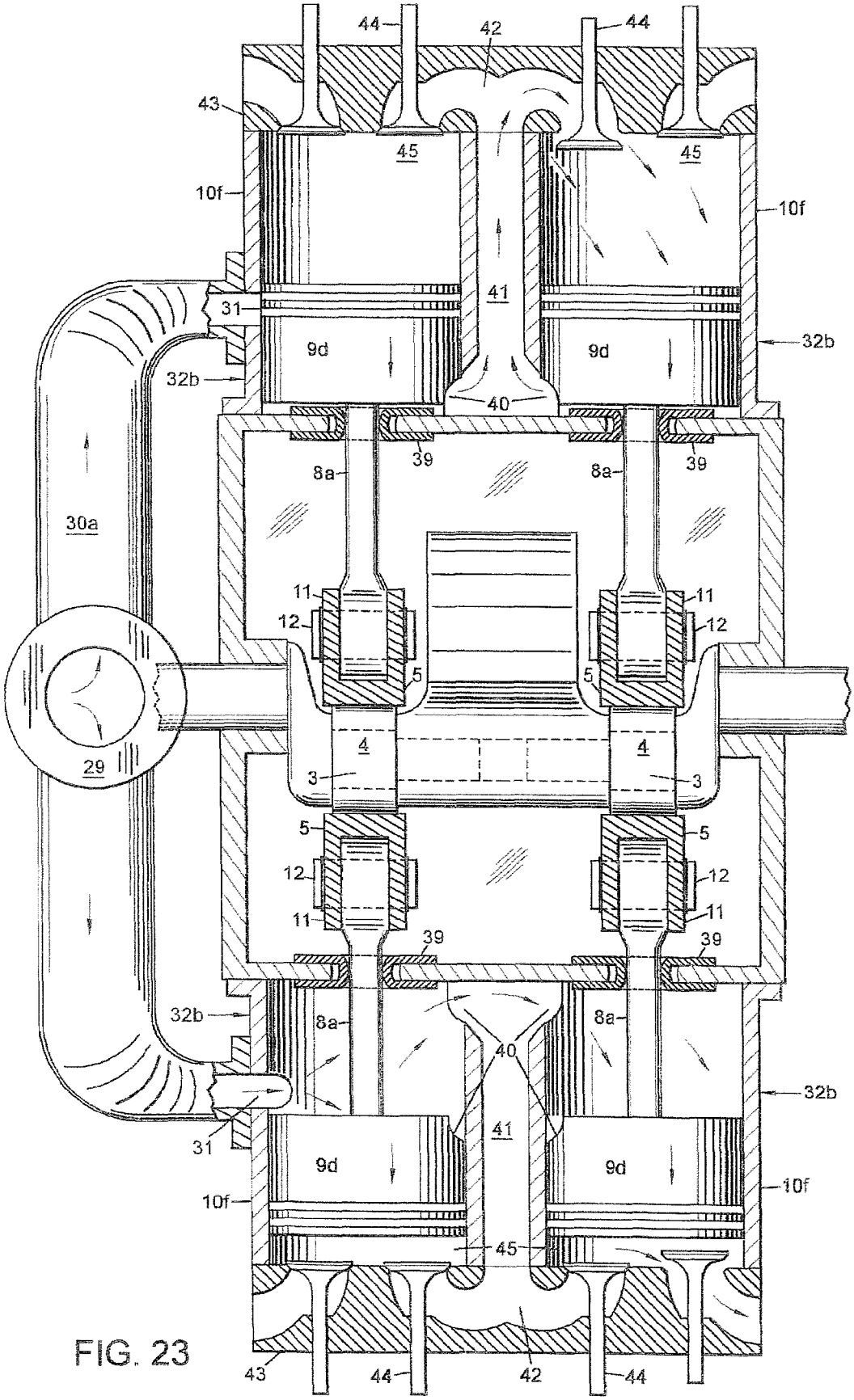
FIG. 23 shows a side sectional view of a 4-stroke, diametrically-opposed four-cylinder, self supercharged, yoke-arm crankshaft engine with the twin-pistons operating under-piston pumps.

In FIG. 23, there is shown a self-supercharged, 4-stroke cycle, four-cylinder diametrically opposed engine. This engine, an improvement compared to prior art, is supercharged by in unison reciprocating, opposed twin-pistons, whereby each twin-piston under-piston pump unit compresses air or air-fuel as a single charging pump.

As shown, an air intake filter or carburetor 29 is connected to intake manifold 30*a* that connects to under-piston intake ports 31 ($3^{rd}$ port). Air or air-fuel is alternately drawn through intake ports 31 into twin-piston, under-piston pumps 32*b* during the upward strokes of pistons 9*d*. During the alternating downward strokes, the two opposed twin-piston pumps 32*b* alternately compress air or air-fuel through centrally located two opposed pairs of pump cylinder ports 40 (located at the bottom of pumps 32*b* under-piston chamber) and through opposed twin-cylinder transfer ports 41 (located between the cylinders) to twin intake ports 42 located within cylinder heads 43. During each stroke, one of the four intake valves 44 opens allowing compressed air or air-fuel to flow into the associated combustion chamber 45. When using air-fuel-oil, an appropriate passage(s) through the crankcase head will allow mist lubrication, wherein replacing the crankcase oil lubrication system.

These twin-piston charging pumps 32*b* have twice the volume displacement when compared to the intake stroke volume for each single cylinder, therefore during each two stroke, under-piston pumping cycle, air pressure and flow is greatly improved for alternately charging one cylinder at a time. Pump 32*b* will also operate with in-line twin, V-4 or V-8 and two row radial configurations. The advantages of the twin-piston high performance supercharger 32*b* are high volumetric efficiencies without the weight, space and cost associated with conventional superchargers.

Another alternative twin-piston, under-piston pump arrangement provides single row engines that are arranged as a V-type or radial engine having one or more V-twin cylinders (ideally with the twin cylinders positioned close together), but this one row arrangement will have reduced pump efficiency. This reduced efficiency is caused by the lower pump pressures that result from twin-pistons which are not reciprocating simultaneously.

For other 4-stroke arrangements, such as in-line type or V-type, under-piston pump 32*b* can be replaced by crankcase compression for providing the advantage of crankcase air-fuel-oil mixing, but with less power gain than FIG. 23. For options, various combinations of single-cylinders and/or in-line twin-cylinders with crankcase pump units can be used to provide different multicylinder arrangements.

Figure 24:
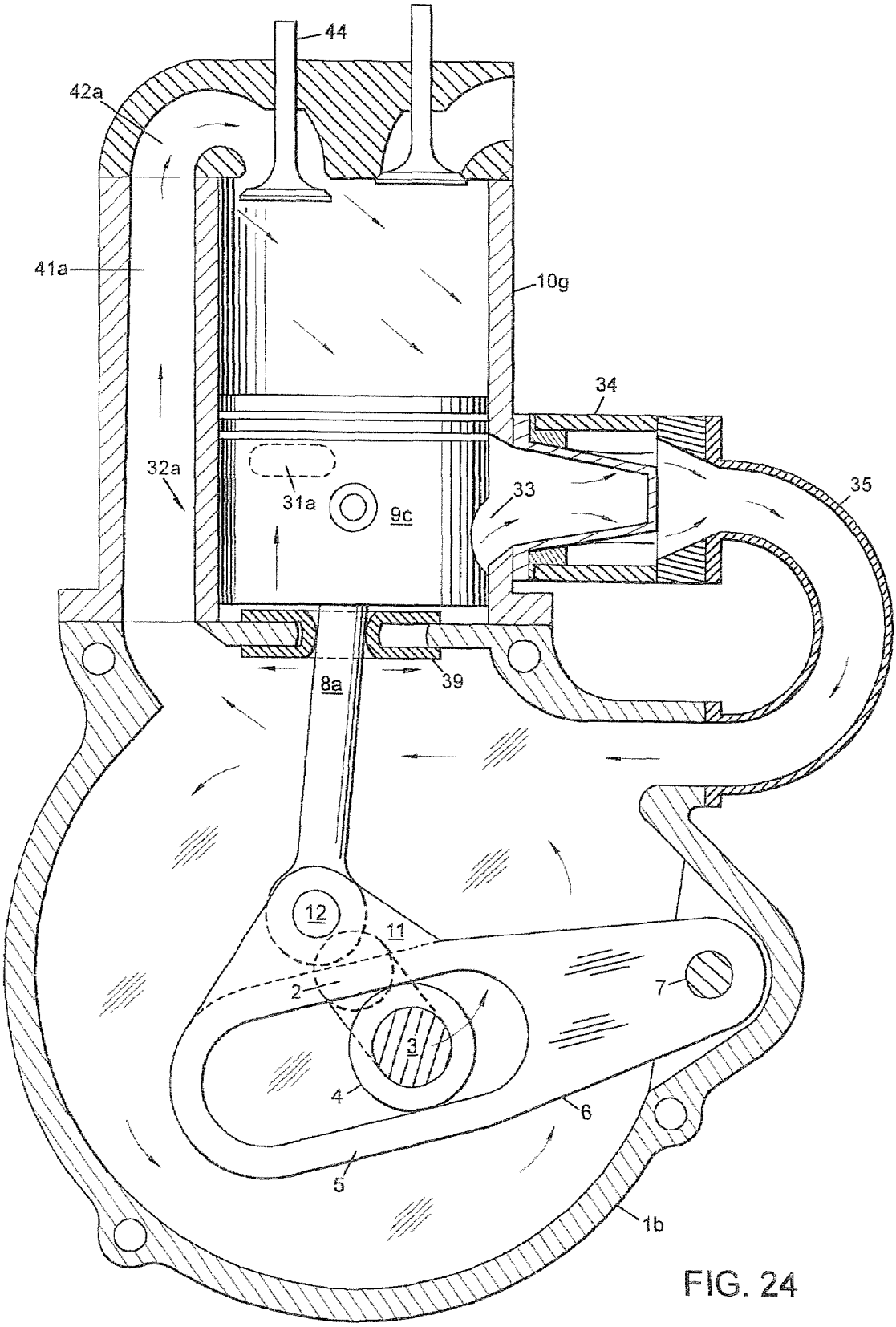
FIG. 24 shows a front sectional view of a 4-stroke, single-cylinder, self-supercharged, yoke-arm crankshaft engine which is charged by using a combination of an under-piston pump and crankcase compression.

In FIG. 24. there is shown a self-supercharged, 4-stroke cycle single-cylinder engine. Intake port 31*a* provides induction of the charge into under-piston pump 32*a*. The charge is then compressed through pump port 33, reed valve 34 and transfer pipe 35 into crankcase 1*b*. During the engine intake stroke, the compressed charge passes from crankcase 1*b* through single transfer port 41*a* into cylinder head intake port 42*a*, through intake valve 44 and into cylinder 10*g* for combustion. Because of two under-piston compression strokes for every engine intake stroke, there is greatly improved supercharging.

As an alternative, FIG. 24 can be converted to 4-stroke crankcase compression by removing seal 39, seal guide plate, reed valve 34 and transfer pipe 35, but at reduced volumetric efficiency. Various multicylinder in-line and V-type arrangements can be configured.

Figure 25:
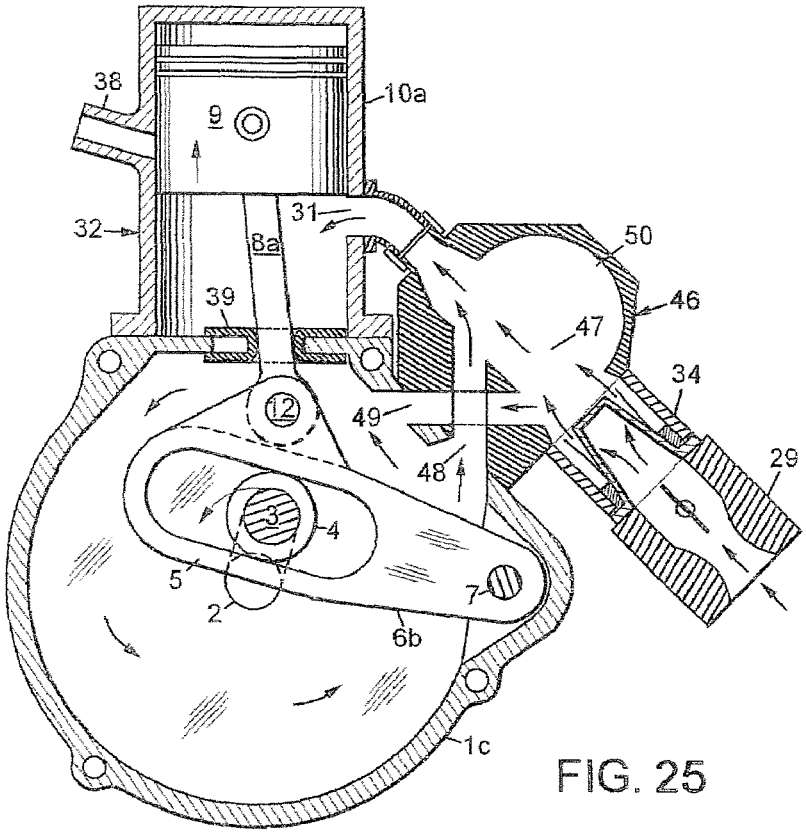
FIGS. 25 & 25A show front sectional views of a 2-stroke, single-cylinder, self-aspirated, yoke-arm crankshaft engine using an intake T-manifold for interconnecting the air-fuel flow between the carburetor, crankcase and under-piston pump.

In FIG. 25, there is shown a self-aspirated, 2-stroke cycle single-cylinder engine which includes a double chamber consisting of an under-piston pump and crankcase that are interconnected by intake T-manifold 46. T-manifold 46 interconnects carburetor 29 to crankcase 1*c* and to one (as shown) or more under-piston pumps 32. Carburetor 29 connects to check valve 34 which is attached to the intake of T-manifold 46. The T-manifold intake begins at main passage 47 with the main passage outlet connected to under-piston intake port 31 ($3^{rd}$ port) of pump 32. A first crankcase passage 48 interconnects the T-manifold's main passage 47 to crankcase 1*c*, whereby the T-manifold provides interconnecting passages for delivering air-fuel from the carburetor and crankcase to under-piston pump 32. Crankcase passage 48 is aligned such to allow the rotating crankshaft to boost charge into T-manifold, thereby permitting more air-fuel flow into pump 32 during the pump's intake stroke.

Figure 25A:
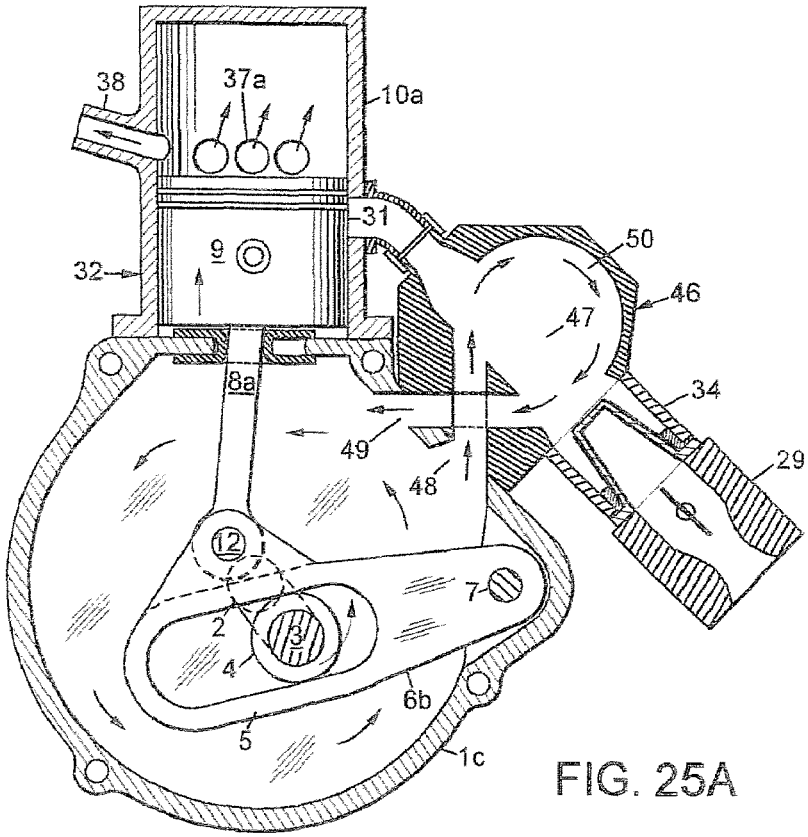

The simplest T-manifold consists of main passage 47 and first crankcase passage 48. For under-piston pump applications, the T-manifold provides improved volumetric efficiencies. To increase the charge flow to pump 32 by the rotating crankshaft, a second crankcase passage 49 (optional) can be added to improve air-fuel flow into the crankcase by creating a loop effect between passages 48 and 49. As shown in FIG. 25A, a semicircle passage 50 within the T-manifold will assist the loop flow into passage 48 and out of passage 49 after closure of the pump intake port 31. This results in reduced turbulence and controlled flow between the crankcase and T-manifold and improves the flow of the charge through main passage 47 when intake port 31 is open as shown in FIG. 25.

When using crankcase oil lubrication, only air passes in-and-out of the crankcase, whereby direct fuel injection or other fuel supply systems can be used. An advantage of the FIG. 25 arrangement is the option of using either an air-fuel-oil mist or oil lubrication system for under-piston pump engines.

Test results show that the combination of under-piston pump, crankcase and T-manifold provides: (1) improved volumetric efficiencies and (2) reduced emissions and improved fuel economy for under-piston pump applications as facilitated by the air-fuel mixing action of the rotating crankshaft.

Some Notable Advantages and Applications of the Invention: The high mechanical and fuel efficiencies for 2 & 4-stroke engines provided by the invention result in less engine weight and fewer emissions compared to prior art engines. The substantial improvements described in this specification allow the 2-stroke engine to replace the heavier and more expensive 4-stroke for many applications. For example, because of lower cost, lower weight, increased reliability and the smaller frontal area typical of 2-stroke engines vs. the 4-stroke, 2-stroke configurations of the invention become ideal for some aircraft applications. Since the invention's three-lobe cam mechanism provides a power shaft rpm reduction equivalent to a 3:1 gear ratio, eliminating transmissions becomes feasible for: (1) engines operating compressors and generators (2) inboard boat engines and (3) helicopters, tiltrotor and fixed wing aircraft engines. When operating with at least two power cylinders for each unit-row and as a 2-stroke, self-supercharged gasoline engine (at the same nominal cycle rates as conventional reciprocating engines), unit weights of less than 0.7 lb. per hp are achievable for the invention. This is less than one-half the weight of conventional horizontal-opposed 4-stroke aircraft engines for the same hp. Configured as a 2-stroke, six-cylinder radial aircraft engine, less than 0.5 lb. per hp is achievable. Also, because of substantially increased piston dwell, higher rpm and shorter strokes are possible which further reduces the weight to power ratio.

Invention's Fuel Efficiencies: When configured for optimum fuel efficiency, test results indicate that fuel consumption is approximately 0.22 lb. per hp hr. When comparing the invention's 2-stroke gasoline engine to the conventional 4-stroke gasoline engine, some projected fuel economy improvement factors are 1.5 for automobile engines and 1.35 for aircraft engines. Compared to the large truck 4-stroke, low rpm conventional diesel engine, a factor of 1.5 fuel economy improvement is projected. For diesel automobiles, a factor of 2.0 improvement is projected.

Although preferred embodiments of the invention have been described in the foregoing detailed description and illustrated in the accompanied drawings, it shall be understood that the invention is not limited to the embodiments disclosed, but is capable of numerous rearrangements, modifications and substitutions of parts and elements without departing from the spirit of the invention. Accordingly, the present invention is intended to encompass such rearrangements, modifications and substitutions of parts and elements as fall within the scope of the invention.

I claim:

1. A reciprocating piston machine of the crankshaft beam type, the machine comprising:

at least one throw with attached crankpin included with a crankshaft that is rotatably mounted in a crankcase;

a beam connecting rod having a lower and an upper end, the beam connecting rod pivotally connected at its lower end to the crankpin;

first and second rocker beam disposed on one side of the crankshaft and extending in generally opposite directions, the centrally located end of each beam is pivotally connected to the upper one end of the beam connecting rod by a beam rod pin, the centrally located end of the first beam having a beam pinhole that the beam rod pin passes through, the centrally located end of the second beam having a beam bearing slot that the beam rod pin passes through, the beam rod pin reciprocating within the beam bearing slot in the general direction of the longitudinal axis of the second beam, the first and second beams connected to the beam rod pin by a siamesed, side-by-side or forked type connection;

fixed pivot pins attached to the crankcase, each pivot pin pivotally connecting their respective beam at a generally central pivotal axis;

at least one cylinder and operatively associated piston mounted for reciprocation within the cylinder, the at least one cylinder attached to the crankcase; and at least one piston rod, at least one end of the beams functionally connected to a corresponding piston rod, the opposite end of the piston rod pivotally connected to the piston.

2. The machine of claim 1 including two pair of opposed pistons with corresponding piston rods, wherein the outer end of each beam is connected to one pair of opposed pistons.

3. The machine of claim 1 further comprising at least one balancing weight, wherein the balancing weight is attached to the outer end of at least one of the rocker beams.

4. The machine of claim 1 further comprising a slot bearing that the beam rod pin passes through, and the slot bearing reciprocates within the bearing slot.

5. The machine of claim 1 further comprising:

at least one piston rod pin connected to at least one corresponding outer end of the rocker beams, wherein each piston rod pin is connected to at least one piston by at least one corresponding piston rod;

the lower end of at least one piston rod is connected to the piston rod pin or to the beam rod pin, the corresponding cylinder axis being generally tangent to the lower or central section of the arc defined by the motion of the corresponding piston rod pin, or when the cylinder axis intersects the arc's central section, in accordance the angle as measured at mid-stroke and formed by the intersection of the cylinder axis and a line connecting the yoke-follower arm pivot pin to the piston rod pin is substantially greater than 90 degrees, the piston dwell increase is proportional to the amount of angle greater than 90 degrees.

6. The machine of claim 1 wherein the reciprocating piston machine comes from the group including internal combustion engines, compressors, steam engines, fluid motors and pumps that operate with piston power drive equipment such as vehicles, air conditioners and power tools.

7. A reciprocating piston machine of the crankshaft beam type, the machine comprising:

at least one throw with attached crankpin included with a crankshaft that is rotatably mounted in a crankcase;

a pair of beam connecting rods pivotally connected at their centrally located inner ends to the crankpin and extending in generally opposite directions;

a pair of rocker beams, extending in opposite directions, disposed on opposite sides of the crankshaft, the centrally located ends of the rocker beams pivotally connected to the outer ends of the corresponding beam connecting rods, the beams pivotally supporting the beam connecting rods;

fixed pivot pins attached to the crankcase, each pivot pin pivotally connecting their respective beam at a generally central pivotal axis;

at least one cylinder and operatively associated piston mounted for reciprocation within the cylinder, the at least one cylinder attached to the crankcase; and at least one piston rod, at least one end of the rocker beams functionally connected to a corresponding piston rod, the opposite end of the piston rod pivotally connected to the piston.

8. The machine of claim 7 further comprising at least one balancing weight, wherein at least one balancing weight is attached to at least one corresponding outer end of the rocker beams.

9. The machine of claim 7 comprising a plurality of rows, wherein the plurality of rows are suitably arranged for providing offsetting inertia forces and dynamic balance.

10. The machine of claim 7 wherein the reciprocating piston machine comes from the group including internal combustion engines, compressors, steam engines, fluid motors and pumps that operate with piston power drive equipment such as vehicles, air conditioners and power tools.

* * * * *